US010879637B2

(12) United States Patent
Chung et al.

(10) Patent No.: US 10,879,637 B2
(45) Date of Patent: Dec. 29, 2020

(54) CONNECTOR ASSEMBLY FOR HIGH-SPEED DATA TRANSMISSION

(71) Applicant: Tesla, Inc., Palo Alto, CA (US)

(72) Inventors: In Jae Chung, San Jose, CA (US); Zheng Gao, Sunnyvale, CA (US); Ron Rosenberg, San Francisco, CA (US); Joel Torres Diaz, San Francisco, CA (US); Adnan Esmail, Palo Alto, CA (US); Satyan Chandra, Mountain View, CA (US)

(73) Assignee: Tesla, Inc., Palo Alto, CA (US)

( * ) Notice: Subject to any disclaimer, the term of this patent is extended or adjusted under 35 U.S.C. 154(b) by 0 days.

(21) Appl. No.: 16/271,559

(22) Filed: Feb. 8, 2019

(65) Prior Publication Data

US 2019/0252812 A1 Aug. 15, 2019

Related U.S. Application Data

(60) Provisional application No. 62/629,506, filed on Feb. 12, 2018.

(51) Int. Cl.

| | |
|---|---|
| ***H01R 12/75*** | (2011.01) |
| ***H01R 13/631*** | (2006.01) |
| ***H01R 12/72*** | (2011.01) |
| ***H01R 13/52*** | (2006.01) |
| ***H01R 13/424*** | (2006.01) |
| ***H01R 13/627*** | (2006.01) |
| ***H01R 24/60*** | (2011.01) |

(52) U.S. Cl.

CPC ..... *H01R 12/75* (2013.01); *H01R 12/724* (2013.01); *H01R 13/424* (2013.01); *H01R 13/5219* (2013.01); *H01R 13/6273* (2013.01); *H01R 13/631* (2013.01); *H01R 24/60* (2013.01)

(58) Field of Classification Search

CPC .... H01R 12/75; H01R 12/724; H01R 13/424; H01R 13/5219; H01R 13/6273; H01R 13/631; H01R 24/60

USPC ..... 439/78

See application file for complete search history.

(56) References Cited

U.S. PATENT DOCUMENTS

| | | | | |
|---|---|---|---|---|
| 5,096,436 | A * | 3/1992 | Noschese | H01R 13/6275 29/876 |
| 5,546,278 | A * | 8/1996 | Bethurum | G06K 19/077 174/365 |
| 6,821,139 | B1 * | 11/2004 | Wu | H01R 13/6275 439/352 |
| 7,530,818 | B1 * | 5/2009 | Wang | H01R 31/065 439/638 |
| 8,096,837 | B2 * | 1/2012 | Kan | H01R 13/501 439/638 |
| 9,865,973 | B2 * | 1/2018 | Engl | H01R 13/6594 |
| 10,381,776 | B2 * | 8/2019 | Wu | H01R 13/635 |

(Continued)

*Primary Examiner* — Harshad C Patel

(74) *Attorney, Agent, or Firm* — Knobbe, Martens, Olson & Bear, LLP

(57) ABSTRACT

A cable assembly includes a first cable and a second cable that is arranged co-axial to the first cable. Proximal ends of the first and second cables are provided with a connector assembly. The connector assembly from each proximal end is adapted to connect with one another, or a pair of receptacle ports located within a PCB, the PCB being disposed alongside the co-axially arranged first and second cables.

19 Claims, 33 Drawing Sheets

(56) References Cited

U.S. PATENT DOCUMENTS

2003/0186580 A1* 10/2003 Dambach ..... H01R 13/6273 439/497
2004/0067027 A1* 4/2004 Plotts ..... G02B 6/3817 385/75
2005/0086413 A1* 4/2005 Lee ..... G06K 19/077 710/313
2006/0028803 A1* 2/2006 Pocrass ..... G06K 19/077 361/737
2008/0032560 A1* 2/2008 Shi ..... H01R 13/506 439/638
2009/0157914 A1* 6/2009 Hunkins ..... G06F 3/14 710/30
2009/0197459 A1* 8/2009 Yu ..... H01R 4/027 439/497
2011/0223806 A1* 9/2011 You ..... H02J 7/0042 439/620.22
2011/0294334 A1* 12/2011 Phillips ..... G02B 6/4201 439/357
2011/0306244 A1* 12/2011 Zhang ..... H01R 9/034 439/624
2012/0034819 A1* 2/2012 Chen ..... H01R 31/065 439/638
2013/0040485 A1* 2/2013 Ngo ..... H01R 12/75 439/350
2013/0045638 A1* 2/2013 Gui ..... H01R 13/6471 439/660
2013/0323951 A1* 12/2013 Yu ..... H01R 31/065 439/218
2014/0134888 A1* 5/2014 Soubh ..... H01R 13/6658 439/660
2014/0179145 A1* 6/2014 Zhang ..... H01R 13/6275 439/357
2014/0185988 A1* 7/2014 Qi ..... G02B 6/428 385/77
2014/0302694 A1* 10/2014 Qiao ..... H01R 13/6272 439/78
2015/0056839 A1* 2/2015 Zhang ..... H01R 12/724 439/350
2015/0171574 A1* 6/2015 Little ..... H01R 24/60 439/78
2015/0229077 A1* 8/2015 Little ..... H01R 12/724 439/78
2015/0318642 A1* 11/2015 Lee ..... H01R 13/506 439/607.05
2016/0064873 A1* 3/2016 Bucher ..... H01R 12/7076 385/88
2016/0118755 A1* 4/2016 Chen ..... H01R 13/717 439/620.21
2017/0040745 A1* 2/2017 Phillips ..... H01R 13/6581
2017/0133777 A1* 5/2017 Little ..... H01R 24/60
2017/0194754 A1* 7/2017 Tsai ..... H01R 13/502

* cited by examiner

| FREQUENCY | 0.1GHz | 2.5GHz | 5GHz | 10GHz | 15GHz |
|---|---|---|---|---|---|
| INSERTION LOSS LIMIT | −0.5dB | −1.25dB | −2.0dB | −3.0dB | −4.0dB |

FIG. 28

| FREQUENCY | 0.1GHz | 2.5GHz | 5GHz | 7.5GHz | 10GHz | 15GHz |
|---|---|---|---|---|---|---|
| RETURN LOSS LIMIT | −20dB | −15dB | −15dB | −10dB | −10dB | −6dB |

FIG. 29

| FREQUENCY | 0.1GHz | 2.5GHz | 6GHz | 10GHz | 15GHz |
|---|---|---|---|---|---|
| SCD21 (through) LIMIT | −28dB | −20dB | −20dB | −20dB | −20dB |

FIG. 30

| FREQUENCY | 0.1GHz | 2.5GHz | 5GHz | 10GHz | 15GHz |
|---|---|---|---|---|---|
| NEAR END CROSS TALK LIMIT | −36dB | −36dB | −36dB | −30dB | −24dB |

FIG. 31

| FREQUENCY | 0.1GHz | 2.5GHz | 5GHz | 10GHz | 15GHz |
|---|---|---|---|---|---|
| FAR END CROSS TALK LIMIT | −34dB | −34dB | −30dB | −24dB | −24dB |

FIG. 32

| CONNECTOR ASSEMBLY #1 | | BOARD | | CONNECTOR ASSEMBLY #2 | |
|---|---|---|---|---|---|
| PIN | SIGNAL NAME | BRIDGE NAME | | PIN | SIGNAL NAME |
| A2 | TX1_P | 1 | HS1_P | A10 | RX1_P |
| A3 | TX1_N | 2 | HS1_N | A9 | RX1_N |
| A4 | TX2_P | 3 | HS2_P | A8 | RX2_P |
| A5 | TX2_N | 4 | HS2_N | A7 | RX2_N |
| A7 | RX2_N | 5 | HS3_N | A5 | TX2_N |
| A8 | RX2_P | 6 | HS3_P | A4 | TX2_P |
| A9 | RX1_N | 7 | HS4_N | A3 | TX1_N |
| A10 | RX1_P | 8 | HS4_P | A2 | TX1_P |
| B1 | SBU1_P | 9 | LS1_P | B11 | SBU2_P |
| B4 | SBU1_N | 10 | LS1_N | B8 | SBU2_N |
| B8 | SBU2_N | 11 | LS2_N | B4 | SBU1_N |
| B11 | SBU2_P | 12 | LS2_P | B1 | SBU1_P |
| B9,B10 | PWR_TX | 13,14 | PWR_A | B2,B3 | PWR_RX |
| B2,B3 | PWR_RX | 15,16 | PWR_B | B9,B10 | PWR_TX |
| A1,A6,A11,B5,B7 | GND | 17,18,19,20 | GND | A1,A6,A11,B5,B7 | GND |
| B6 | DETECT | N/A | DETECT | B6 | DETECT |

*FIG. 33*

CONNECTOR ASSEMBLY FOR HIGH-SPEED DATA TRANSMISSION

CROSS REFERENCE TO RELATED PATENTS

The present U.S. Utility Patent Application claims priority pursuant to 35 U.S.C. § 119(e) to U.S. Provisional Application No. 62/629,506, entitled "CONNECTOR ASSEMBLY", filed Feb. 12, 2018, which is hereby incorporated herein by reference in its entirety and made part of the present U.S. Utility Patent Application for all purposes.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISC

Not applicable.

BACKGROUND

Technical Field

The present disclosure relates to a connector assembly. More particularly, the present disclosure relates to a connector assembly for connecting high-speed cable segments that provide communication pathways for communicating signals between various electrical components inside a vehicle, particularly at high data rates.

Description of Related Art

Traditional car wiring for vehicles include a plurality of cables for communicating power signals or data signals from one end to another. These cables transmit audio data, video data, safety information, and other data. Due to the advancement of controls and the sensors being installed in vehicles, data transfer rates have exceeded the capacity of simple twisted cables (or coaxial cables). Certain applications, such as those related to driver-assist and autonomous-driving functionality require high data-rate transmission to and from devices such as video cameras, radar sensors, LIDAR sensors, or other sensors. Traditional cable designs are unable to support these high data rates. Further, traditional cables only contain enough conductors to allow for signal transmission along a single path. In addition, a connector assembly that supports the high data-rate and redundant transmissions, while sufficiently preserving signal integrity and providing necessary environmental protection, is imperative for the proper operation and maintenance of the cable and overall system. Preserving signal integrity includes minimizing signal loss to within an allowable range, eliminating crosstalk, and reducing EMI interference.

Therefore, concomitant with advancements in cable design, there is a need for a connector assembly that supplements the functioning of the cables to facilitate high-speed-signal transmission.

BRIEF DESCRIPTION OF THE DRAWINGS

FIG. 28 is a table indicating the maximum allowed insertion loss experienced by the high-speed conductor pairs with reference normalized to a 90-Ohm differential, according to certain embodiments of the current disclosure.

FIG. 29 is a table indicating the maximum allowed return loss experienced by the high-speed conductor pairs with reference normalized to a 90-Ohm differential, according to certain embodiments of the current disclosure.

FIG. 30 is a table illustrating mode conversion according to certain embodiments of the current disclosure.

FIG. 31 is a table of the maximum allowed near-end crosstalk experienced by the high-speed conductor pairs with reference normalized to a 90-Ohm differential, according to certain embodiments of the current disclosure.

FIG. 32 is a table of the maximum allowed far-end crosstalk experienced by the high-speed conductor pairs with reference normalized to a 90-Ohm differential, according to certain embodiments of the current disclosure.

FIG. 33 is a pin table for the connector assemblies and PCB, according to certain embodiments of the current disclosure.

Figure 1:
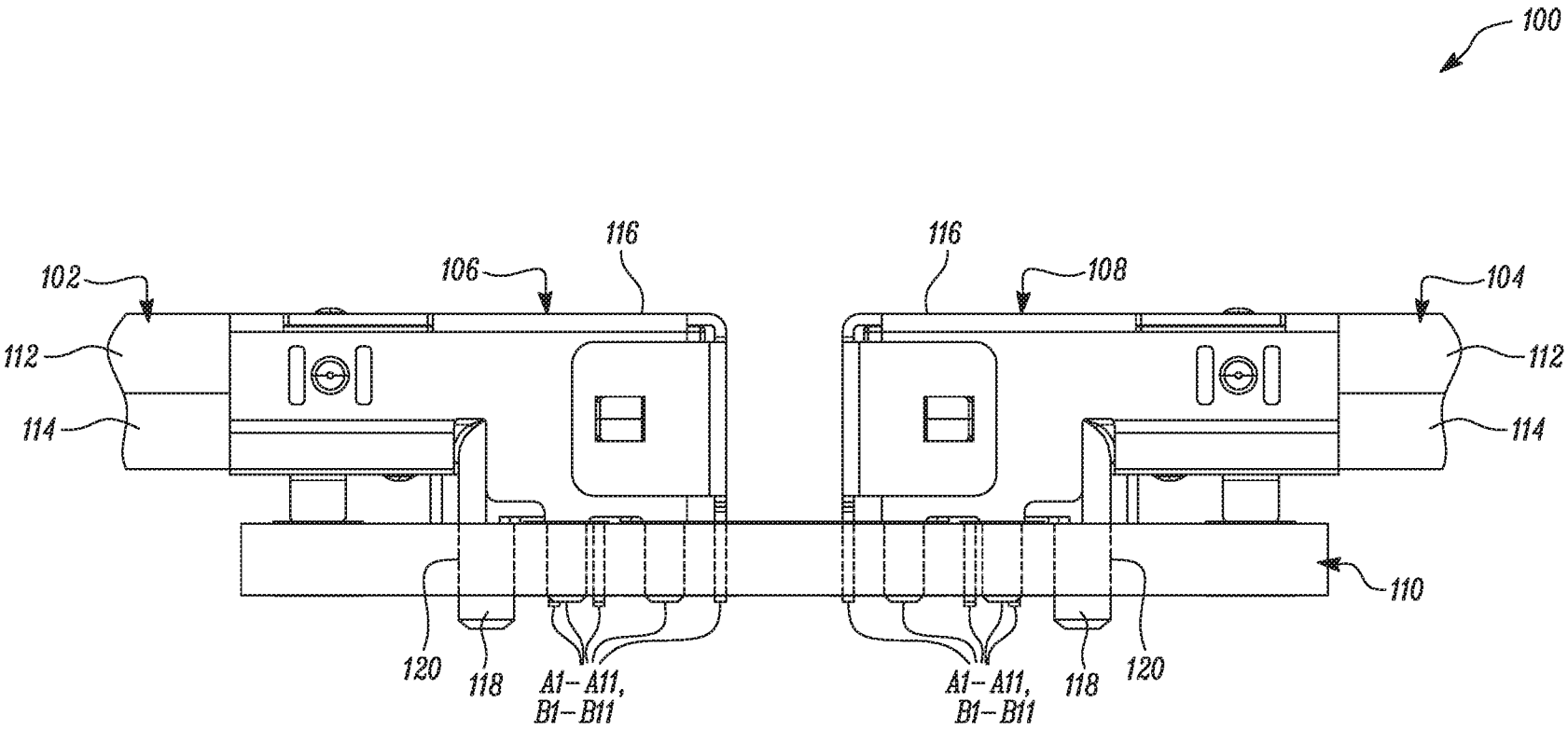
FIG. 1 illustrates a side view of two cable assemblies, each joined to a PCB through a connector assembly according to certain embodiments of the current disclosure.

Embodiments of the present disclosure and their advantages are best understood by referring to the detailed description that follows. It should be appreciated that like reference numerals are used to identify like elements illustrated in one or more of the figures, wherein showings therein are for purposes of illustrating embodiments of the present disclosure and not for purposes of limiting the same.

DETAILED DESCRIPTION OF THE DISCLOSURE

The present disclosure relates to connector assemblies to connect cable assemblies designed to transmit high-speed data transmission. The cable assemblies may also transmit power. High-speed data transmission rates are becoming increasingly important in automobile and other applications, including driver-assist and autonomous-driving functionalities. In embodiments, connector assemblies described herein also detect when adjacently located connector assemblies are being connected or disconnected from one another, thereby allowing devices located upstream or downstream, to be notified of such connection or disconnection being made between adjacently located connectors.

In embodiments, the connector assemblies include attachment features to facilitate a stable positioning of the cable assemblies at their connection point. Further, the attachment features also allow quick attachment and detachment at the connection point. These attachment features may be located internally or externally.

In embodiments, the connector assemblies connect directly connecting to a PCB, which may contain other devices or electronic components. In such configurations, the PCB contains internal routing, which may be printed or formed via another method, to connect multiple cable assemblies to one another or a cable assembly to other sensors of functionality. The internal routing may allow flexibility in positioning ends of the cables or cable segments a little distance away from one another. The internal routing may range from a few millimeters to a few centimeters, for example, 0.5 centimeter to 30 centimeters to provide sufficient space to connect multiple connectors, while sill minimizing the overall size. Minimizing the overall size allows for placement in small spaces, for example, sandwiched between the exterior body panel and interior trim kit.

Reference will now be made in detail to specific aspects or features, examples of which are illustrated in the accompanying drawings. Wherever possible, corresponding or similar reference numbers will be used throughout the drawings to refer to the same or corresponding parts.

Figure 13:
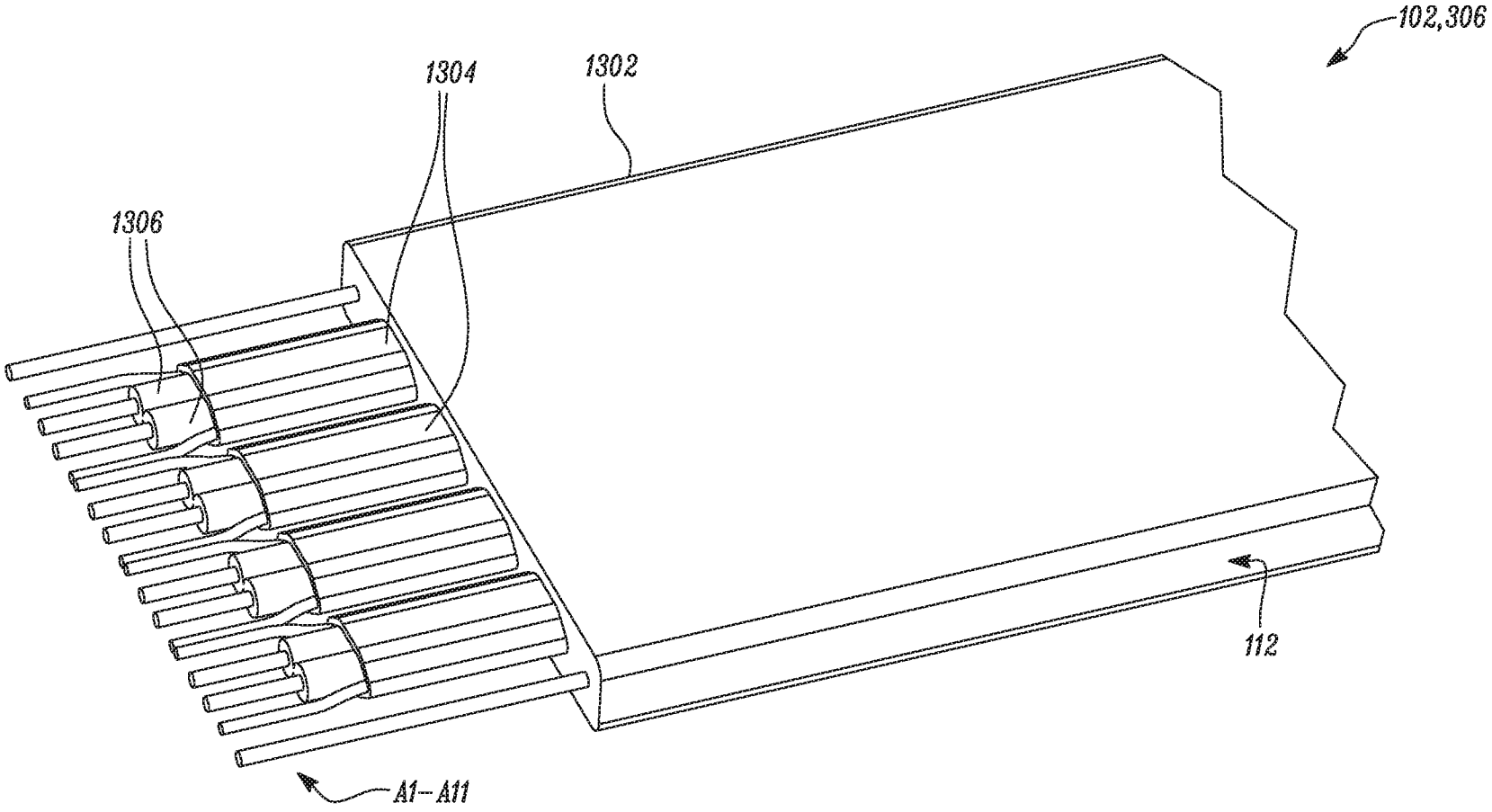
FIGS. 13-27 illustrate a process of assembling a plug-connector assembly onto an end of the cable, according to certain embodiments of the current disclosure.
Figure 14:
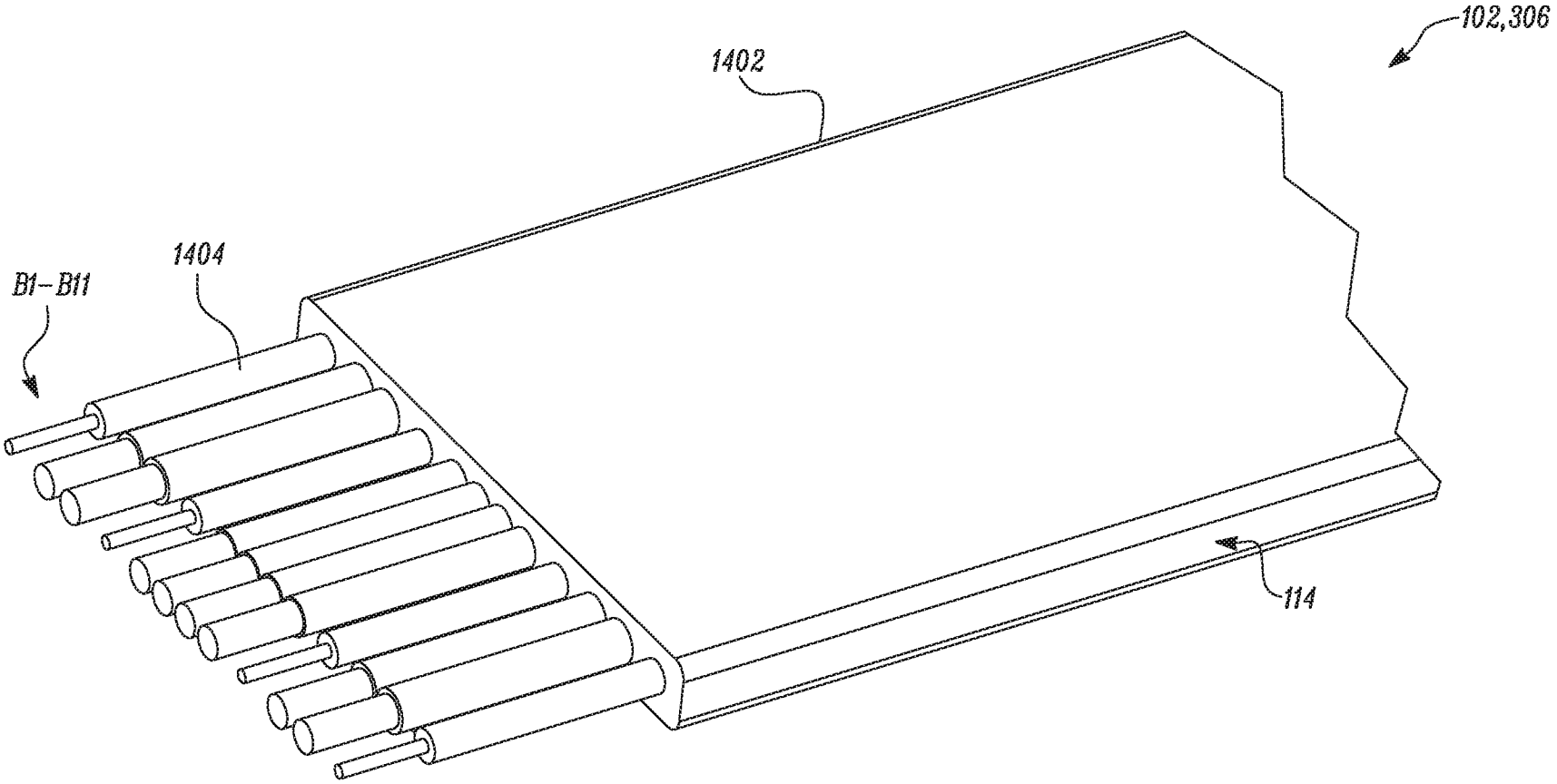

FIG. 1 illustrates a side view of two cable assemblies, each joined to a PCB through a connector assembly according to certain embodiments of the current disclosure. As shown, the connected cable assembly 100 has a first cable assembly 102 and a second cable assembly 104 connected to one another using a pair of connector assemblies 106, 108 and through PCB 110. Each of the first and second cable assemblies 102, 104 include multiple conductors. For instance, the first cable assembly 102 may have two rows 112, 114 of multiple conductors A1-A11 and B1-B11, as shown in FIG. 13 and FIG. 14 respectively.

The conductors may be conductor pairs or differential pairs to transmit data or power signals. Other conductors may be bus connections, grounding conductors, or conductors for detection features as will be evident from certain embodiments of this disclosure. Although specific functions or signal types are associated with specific conductors herein, other configurations of the cable, a type of signal or function associated with each conductor of the cable can vary depending on specific requirements of an application.

With continued reference to FIG. 1, each of the connector assemblies 106, 108 has a body 116. The body 116 may be made of a non-conducting material and may be a dielectric. For example, the body 116 may be made from a dielectric thermoplastic polymer, such as polyvinylidene fluoride (PVDF), a dielectric thermoplastic elastomer (TPE), such as polyurethane (PUR), ethylene propylene rubber (EPR), or another suitable polymer or material. In embodiments, the body 116 is made of a conducting metal, such as steel, aluminum, titanium, or another metal. The body 116 may also be formed of monomers (or shorter-chain polymers) that may be treated during manufacture to alter the properties of the body 116. For example, ultraviolet light, a heat treatment, or application of a solvent, may cause additional polymerization in certain areas of the body 116 to alter the properties of the body 116, such as stiffness, yield strength, hydrophobicity, or another property. The body 116 may be formed through an extrusion process. Alternatively, the body 116 may be formed through a lamination process, or molding, or other processes commonly known to persons skilled in the art.

The body 116 is provided with one or more protruding legs 118. For instance, as shown in FIG. 1, the body 116 of each connector assembly 106, 108 includes a single leg 118. However, any number of legs 118 may be provided to secure the body 116 to a PCB 110. This leg 118 may be coupled to a non-conducting receptacle port 120 on the PCB 110. The coupling of the leg 118 to the non-conducting receptacle port 120 on the PCB 110 may be accomplished by commonly known attachment means, such as, but not limited to, application of a curable two-part adhesive such as an epoxy, or a glue between the leg 118 and the non-conducting receptacle port 120. Alternatively, the leg 118 may be inserted into the non-conducting receptacle port 120 of the PCB 110 to establish an interference fit. This way, once the leg 118 is inserted into the non-conducting receptacle port 120 of the PCB 110, the body 116 of the associated connector assembly 106, 108 would be secured to the PCB 110.

Figure 2:
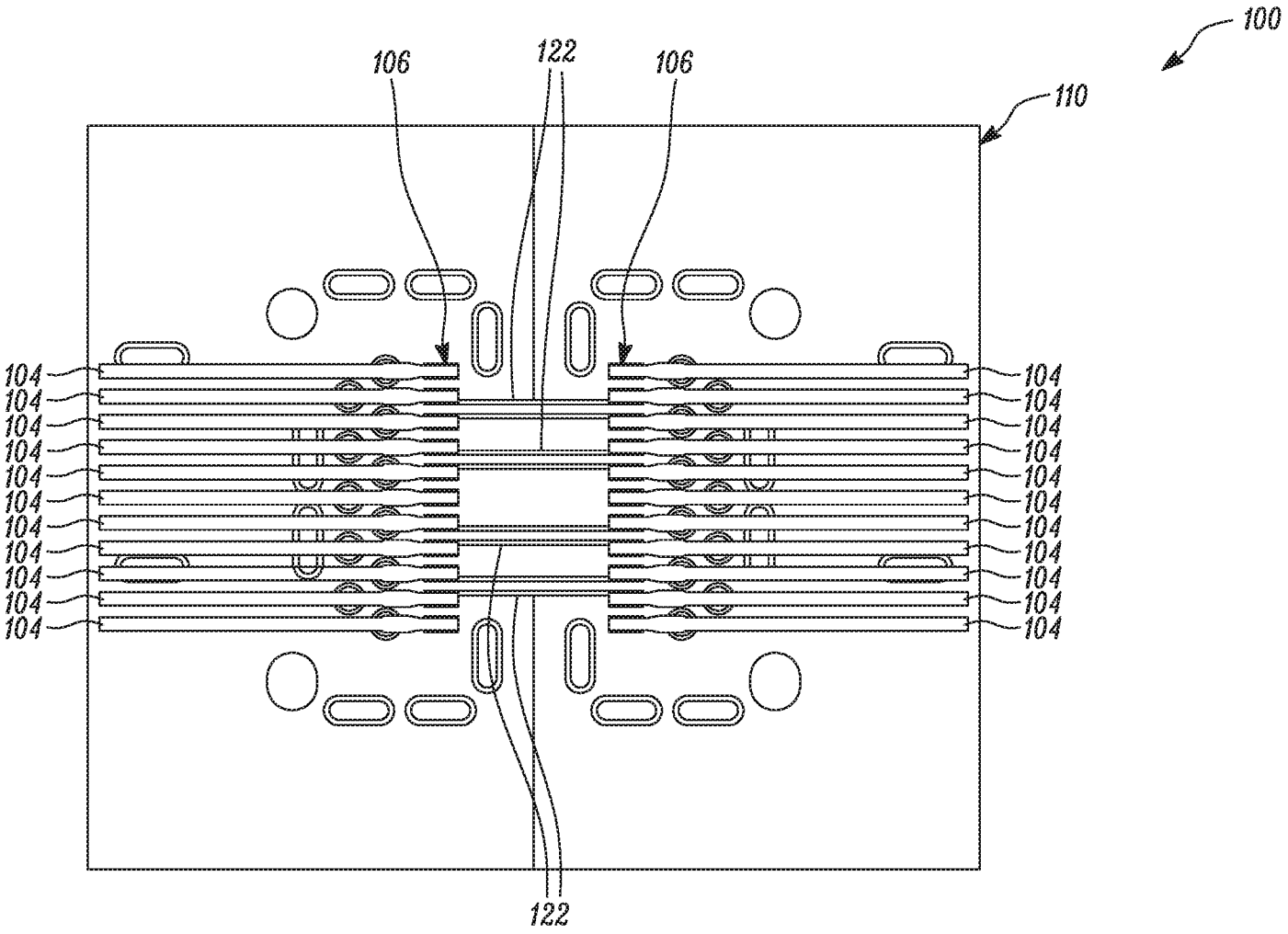
FIG. 2 illustrates a top view of the PCB to which two cable assemblies are connected, each through a connector assembly according to certain embodiments of the current disclosure.

The body 116 of each connector assembly 106, 108 includes multiple conductors A1-A11 and B1-B11 therein. These conductors A1-A11 and B1-B11 may be generally L-shaped but may also be tiered in shape to route communications from conductors A1-A11 and B1-B11 associated with a corresponding one of the cables 102, 104 to corresponding ones of conductive receptacle ports located on the PCB 110. As shown in FIG. 2, certain receptacle ports on the PCB 110 have internal routing 122 associated therewith. The internal routing 122 can route signals from one cable to another, for example, from the first cable 102 to the second cable 104, and vice-versa. These internal routing 122 may be formed within a laminate board of the PCB 110 made of a substrate material, for example, glass fiber together with an epoxy resin. Processes that may be required to manufacture the PCB 110 would be similar to those typically adopted for manufacturing any printed circuit board, for example, lamination, printing, bonding and the like. FIG. 33 illustrates an exemplary schematic of the conductors A1-A11 and B1-B11 present in the connector assemblies 106, 108, and the internal routing 122 present on the PCB 110 according to certain embodiments of the current disclosure.

Figure 3:
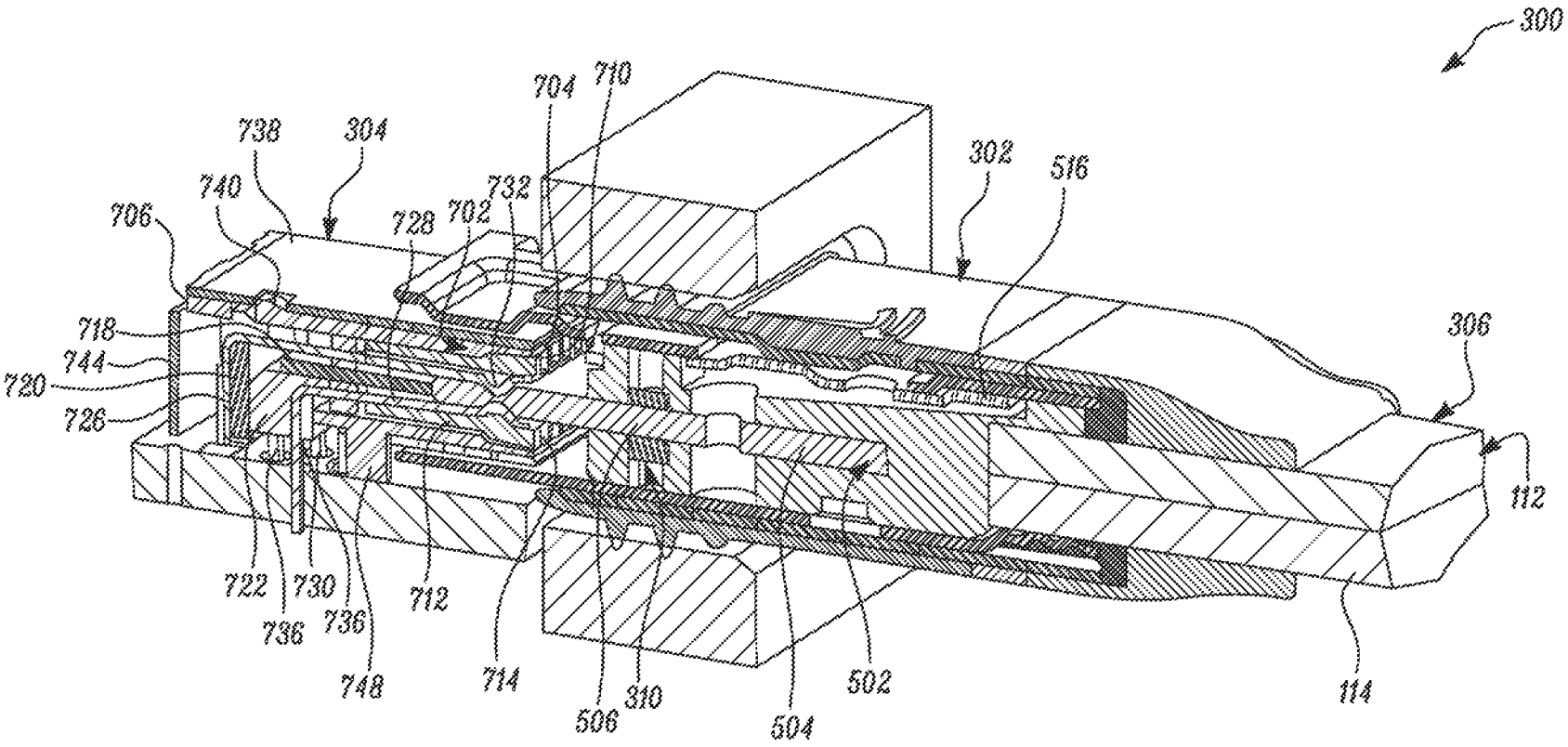
FIG. 3 illustrates a perspective-sectional view of a cable assembly with attached receptacle-connector assembly, which is connected to a PCB according to certain embodiments of the current disclosure.
Figure 4:
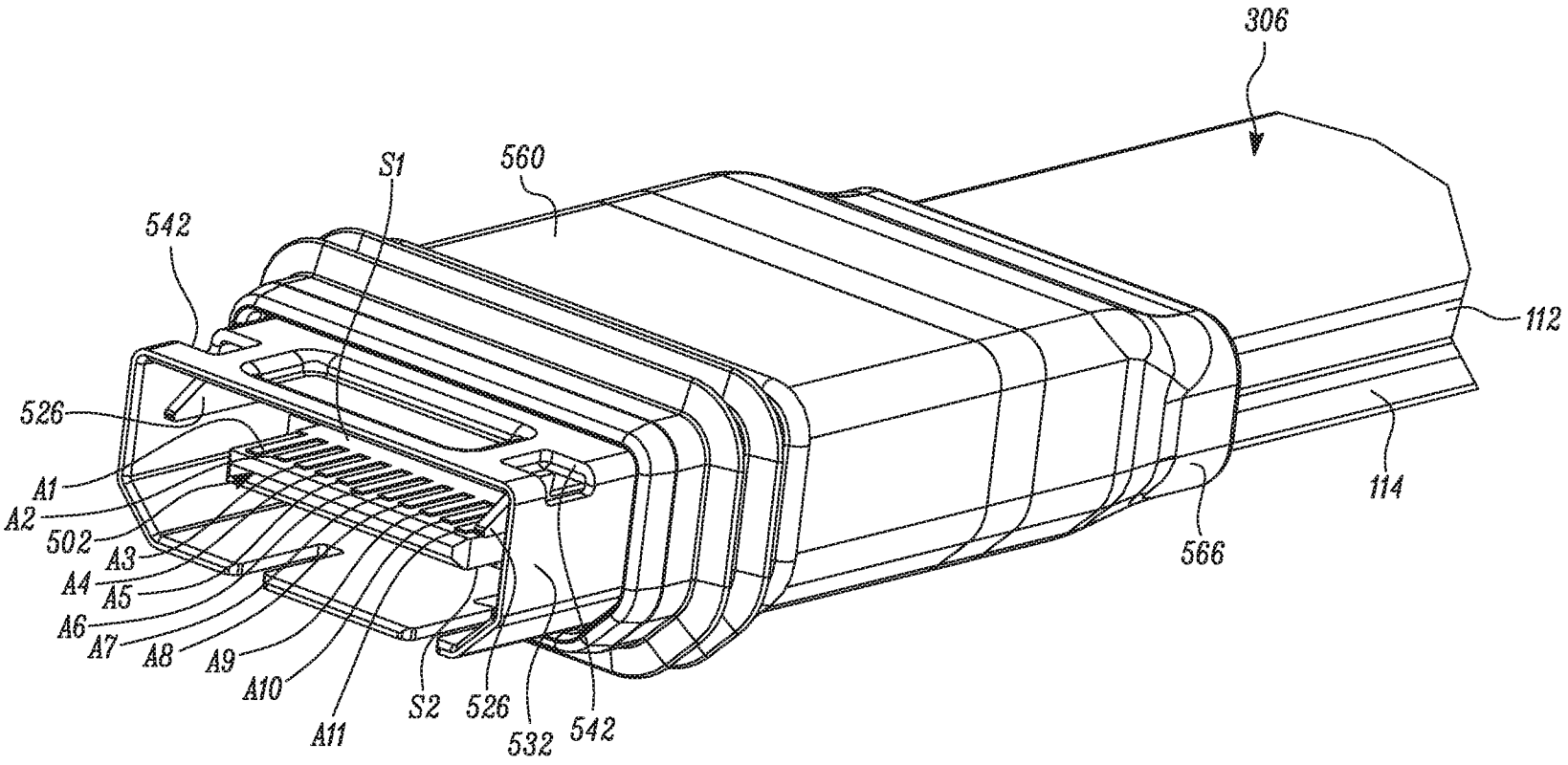
FIG. 4 illustrates a perspective view of a plug-connector assembly connected to a cable assembly according to certain embodiments of the current disclosure.
Figure 5:
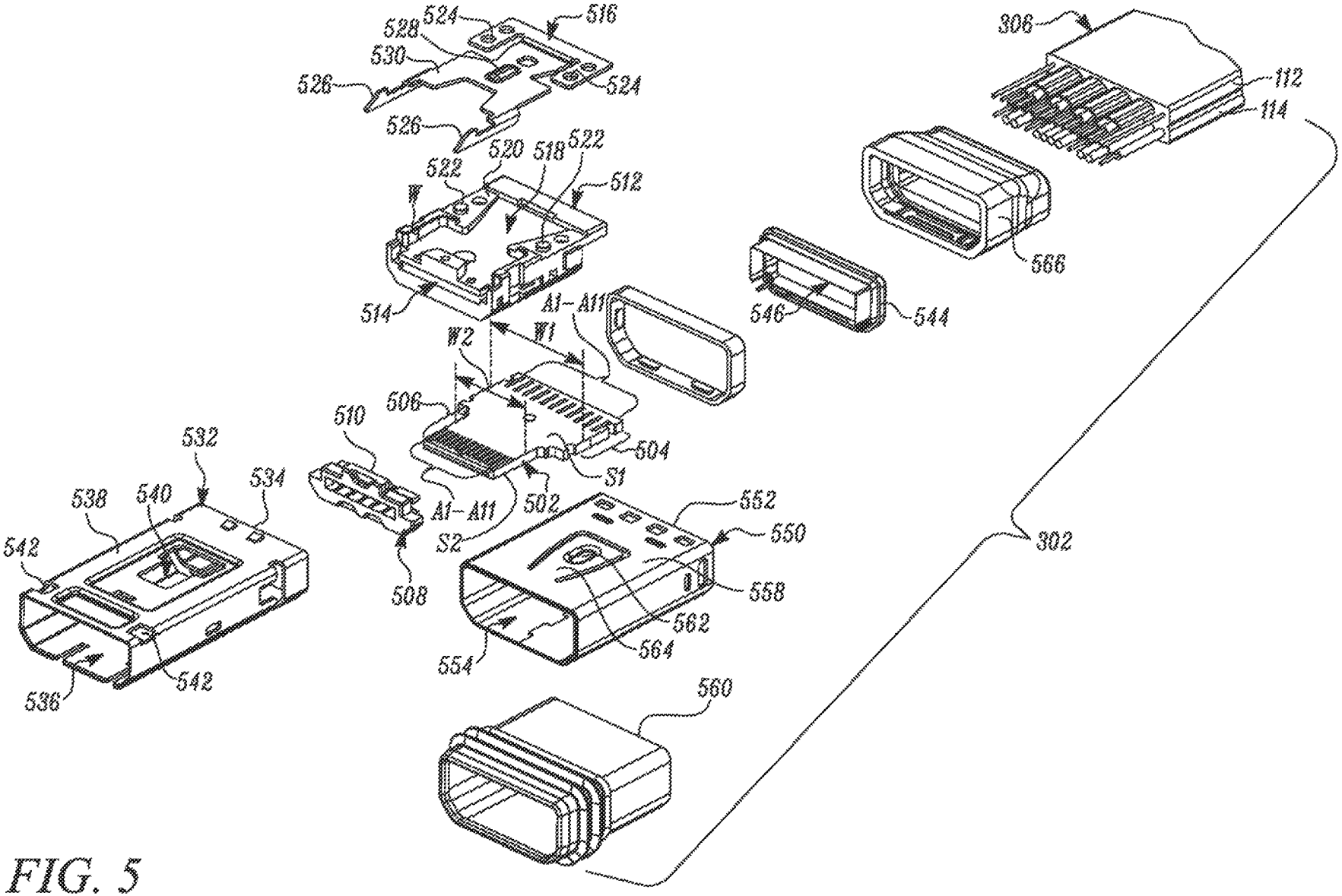
FIG. 5 illustrates an exploded view of the plug-connector assembly according to certain embodiments of the current disclosure.
Figure 6:
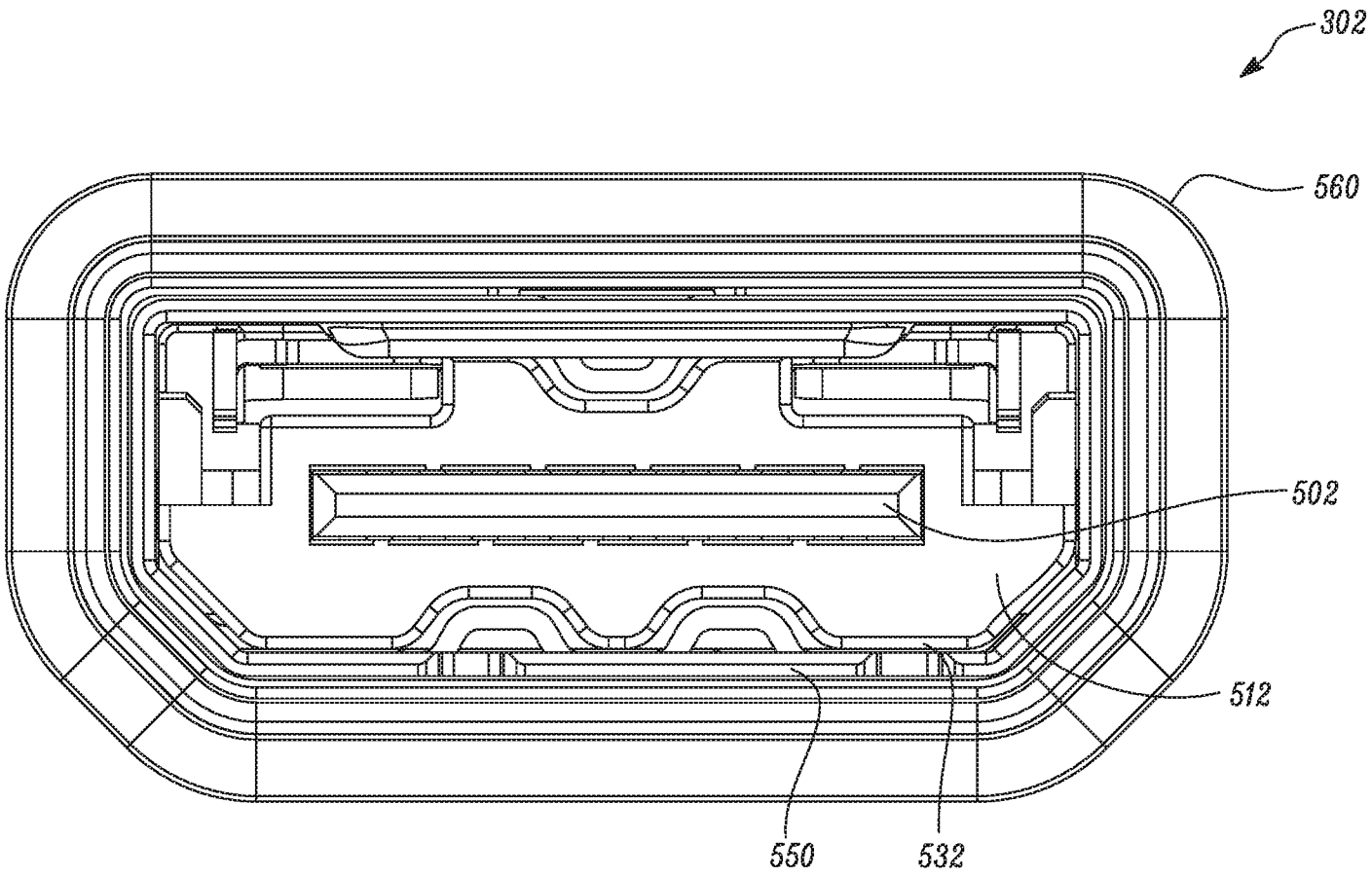
FIG. 6 illustrates a front view of the plug-connector assembly according to certain embodiments of the current disclosure.
Figure 7:
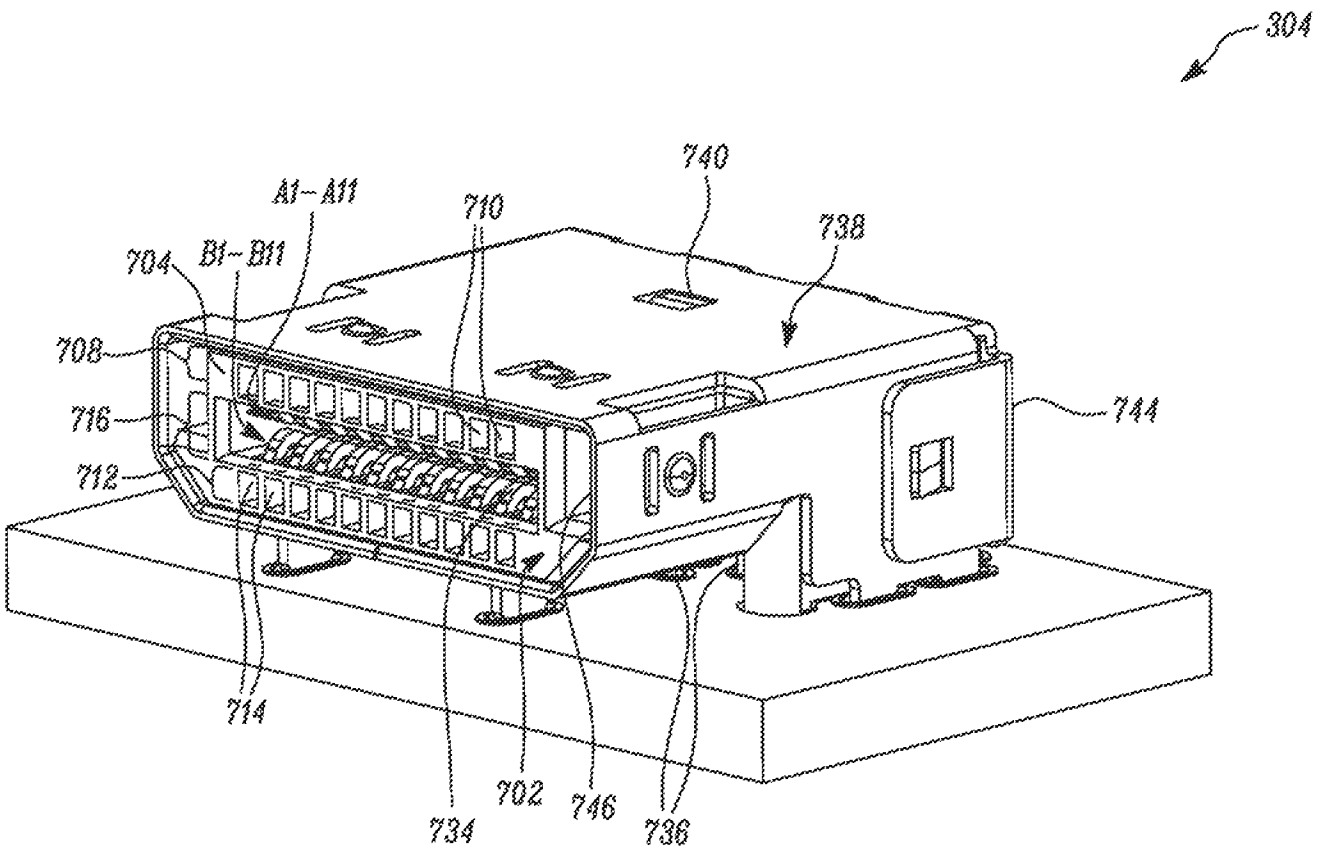
FIG. 7 illustrates a perspective view of the receptacle-connector assembly according to certain embodiments of the current disclosure.
Figure 8:
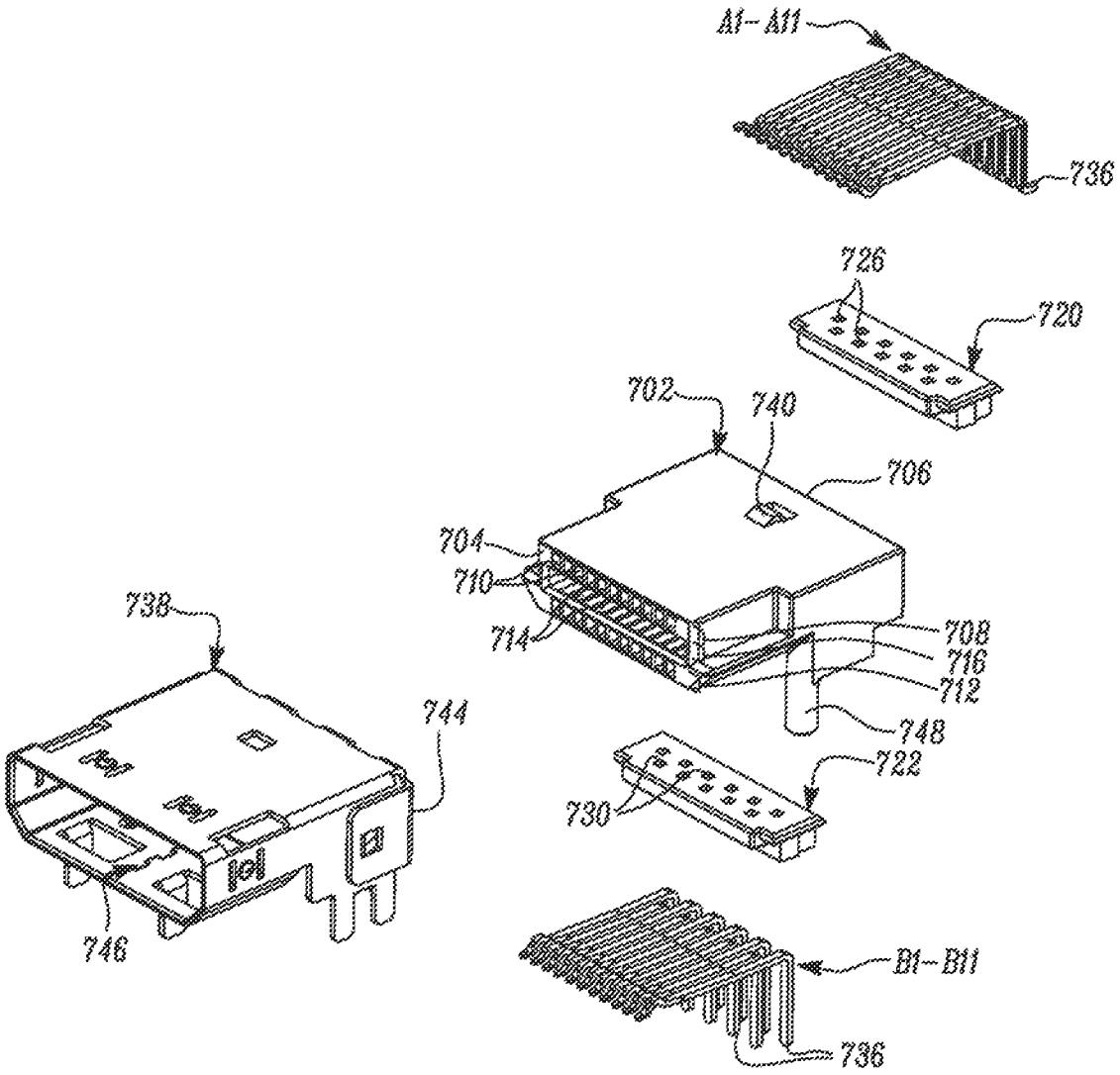
FIG. 8 illustrates an exploded view of the receptacle-connector assembly according to certain embodiments of the current disclosure.
Figure 9:
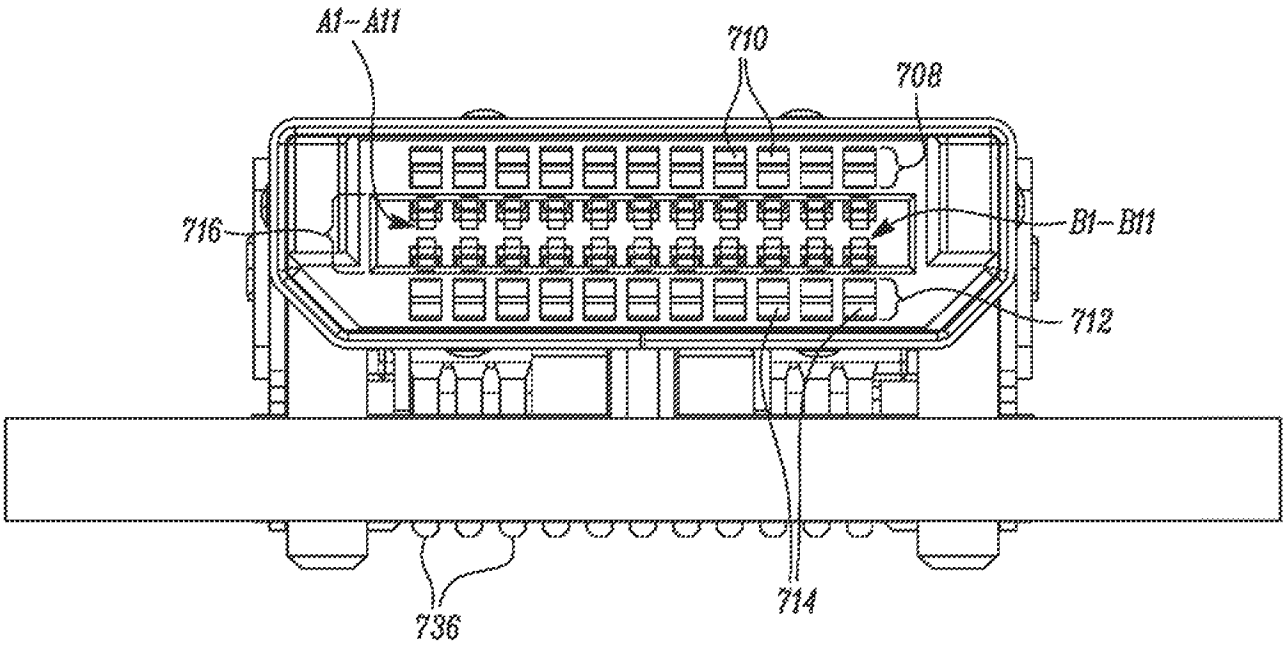
FIG. 9 illustrates a front view of the receptacle-connector assembly, according to certain embodiments of the current disclosure.

FIG. 3 illustrates a sectional view of a connector assembly 300 according to certain embodiments. The connector assembly 300 connects a cable assembly 306 to a PCB (or another component). As shown, the connector assembly 300 includes a plug-connector assembly 302 and a receptacle-connector assembly 304. FIGS. 4, 5, and 6 show the plug-connector assembly 302, in an assembled perspective view, an exploded view, and a front view, respectively. FIGS. 7, 8, and 9 show the receptacle-connector assembly 304, in an assembled perspective view, an exploded view, and a front view, respectively.

During attachment of the cable assembly 306 into the plug-connector assembly 302 or receptacle-connector assembly 304, the cable assembly 306 is stripped of a portion of its outer jacket 1302. Thereafter, other layers outside of the underlying conductors, such as a conductive shield layer 1304, and an insulating layer 1306 may be stripped to their respective pre-specified lengths to expose conductors A1-A11 from the first row 112 of the cable assembly 306.

In an embodiment, encased conductors or wires are held on a flat conveyer or with a robotic arm, and the wires are stripped using a stripping attachment so as to preserve the wire spacing. A laser tool may be used to perform the stripping. The robotic arm (or another robotic arm) may then pick up a plug-connector assembly 302, assembled or pieces thereof, and connect the plug-connector assembly 302 to the conductors by pressing down, soldering, gluing, and/or utilizing other appropriate processes or tools, as will be exemplarily described herein. Similarly, the second row 114 of the cable assembly 306 may be stripped of its outer layers (for example, insulating layer 1404 and outer jacket 1402) to expose conductors B1-B11.

Plug-Connector Assembly

Figure 17:
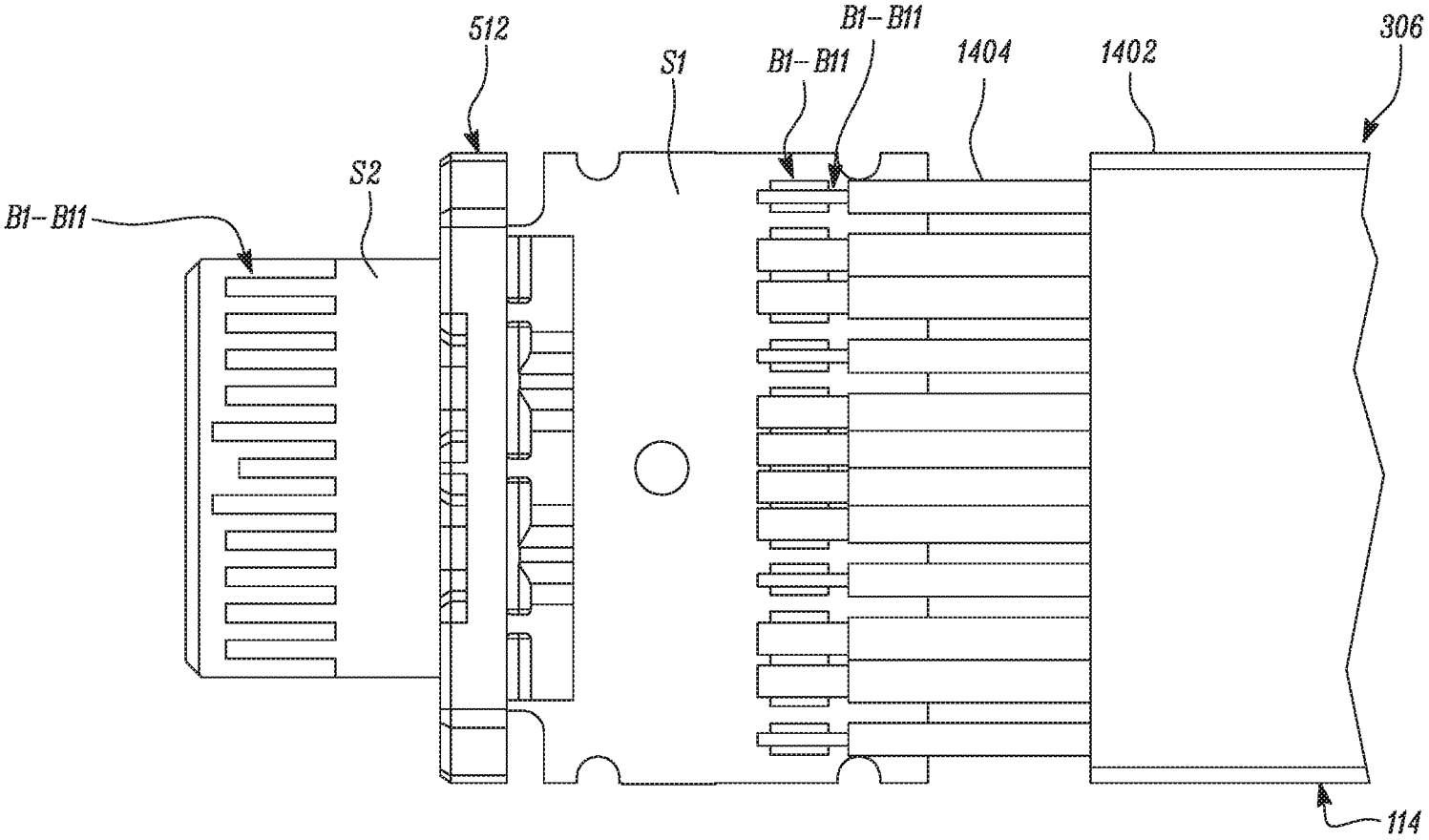

As show in FIGS. 3-5 and 15-16, the plug-connector assembly 302 includes a secondary PCB 502. In embodiments, such as the one shown, the secondary PCB 502 has a stepped configuration, which defines a first portion 504 and a second portion 506. The first portion 504 has a first width W1 and the second portion 506 has a second width W2. In embodiments, W2 is less wide than the first width W1. The secondary PCB 502 has a first side S1 with multiple first conducting portions. These first conducting portions are attached, for example, by soldering, to conductors A1-A11 present on the first row 112 of the cable assembly 306. As shown in FIG. 17, the secondary PCB 502 also includes a second side S2 that has multiple second conducting portions. Similar to the first conducting portions, these second conducting portions may be attached, for example, by soldering to conductors B1-B11. The first conducting portions and the second conducting portions disclosed herein are positioned to across the first width W1 of the first portion 504 or the secondary PCB 502.

Figure 18:
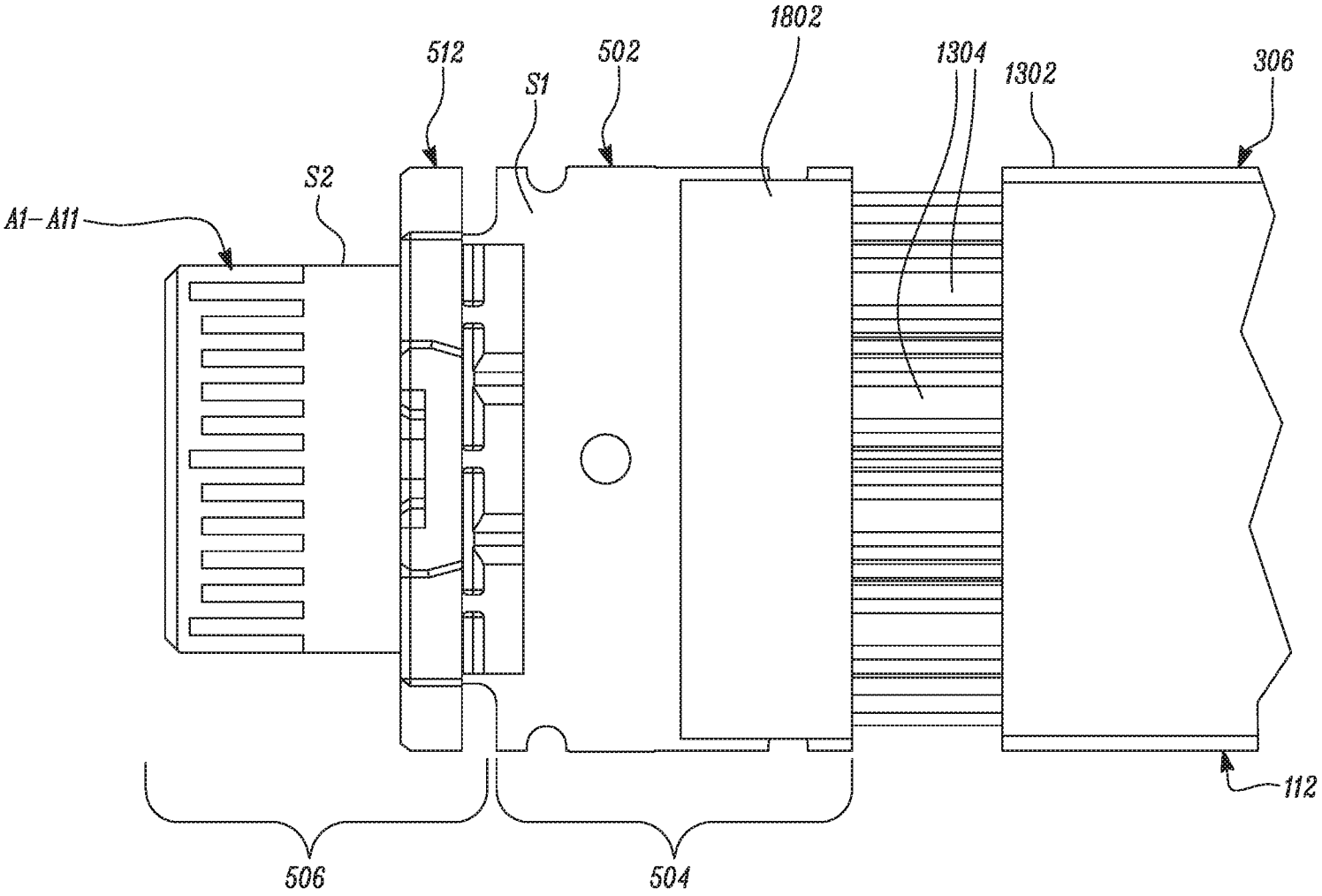
Figure 19:
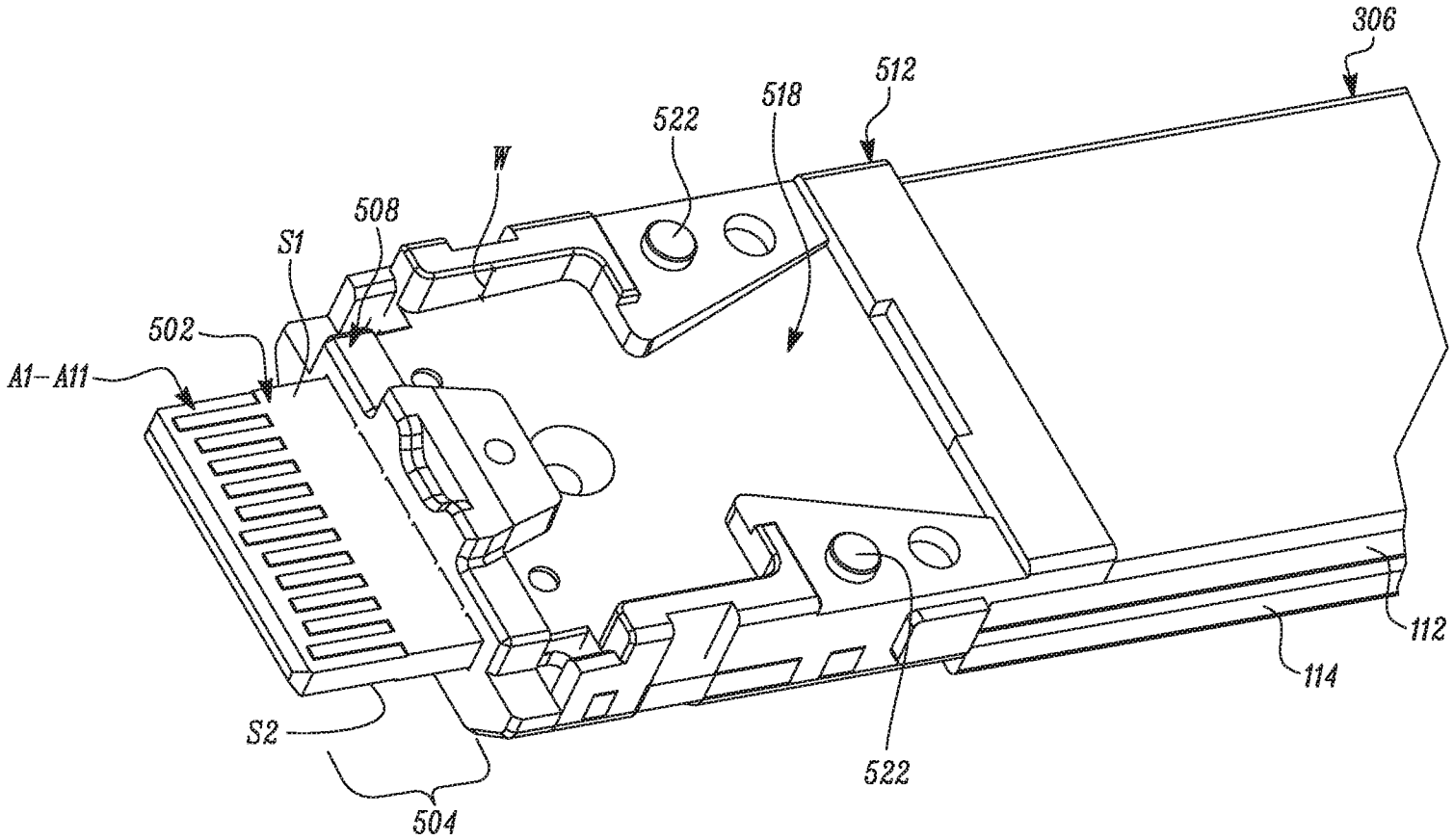

The attached conductors A1-A11 and B1-B11 may be, additionally, or optionally, adhered to the secondary PCB 502 using an adhesive 1802. For example, the attached conductors may be adhered by heat curing/UV curing an epoxy resin onto the soldered portions of the attached conductors A1-A11 and B1-B11 and respective first and second conducting portions as shown in FIG. 18. This optional adhesion further secures the connection from inadvertent detachment during operation.

Figure 15:
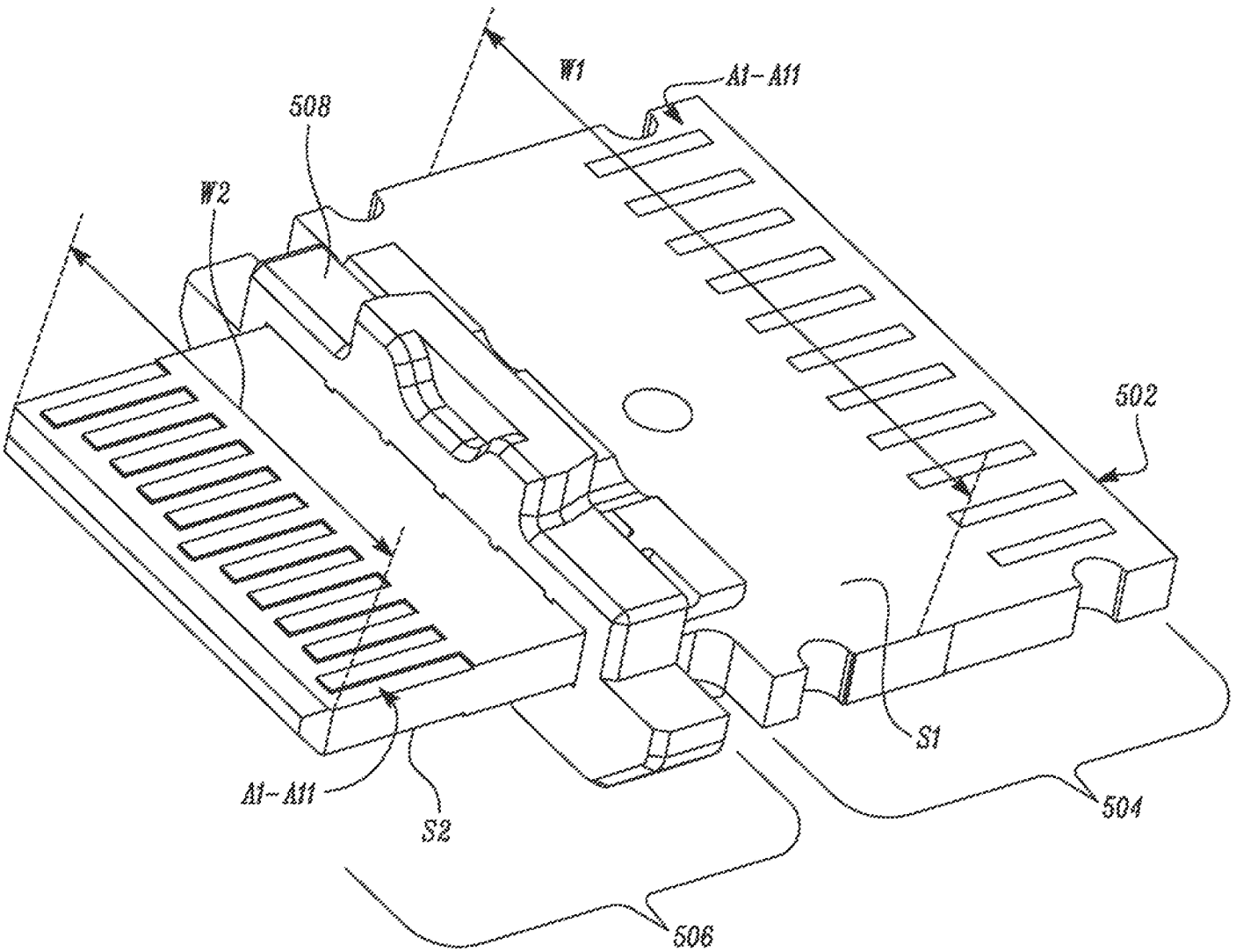
Figure 16:
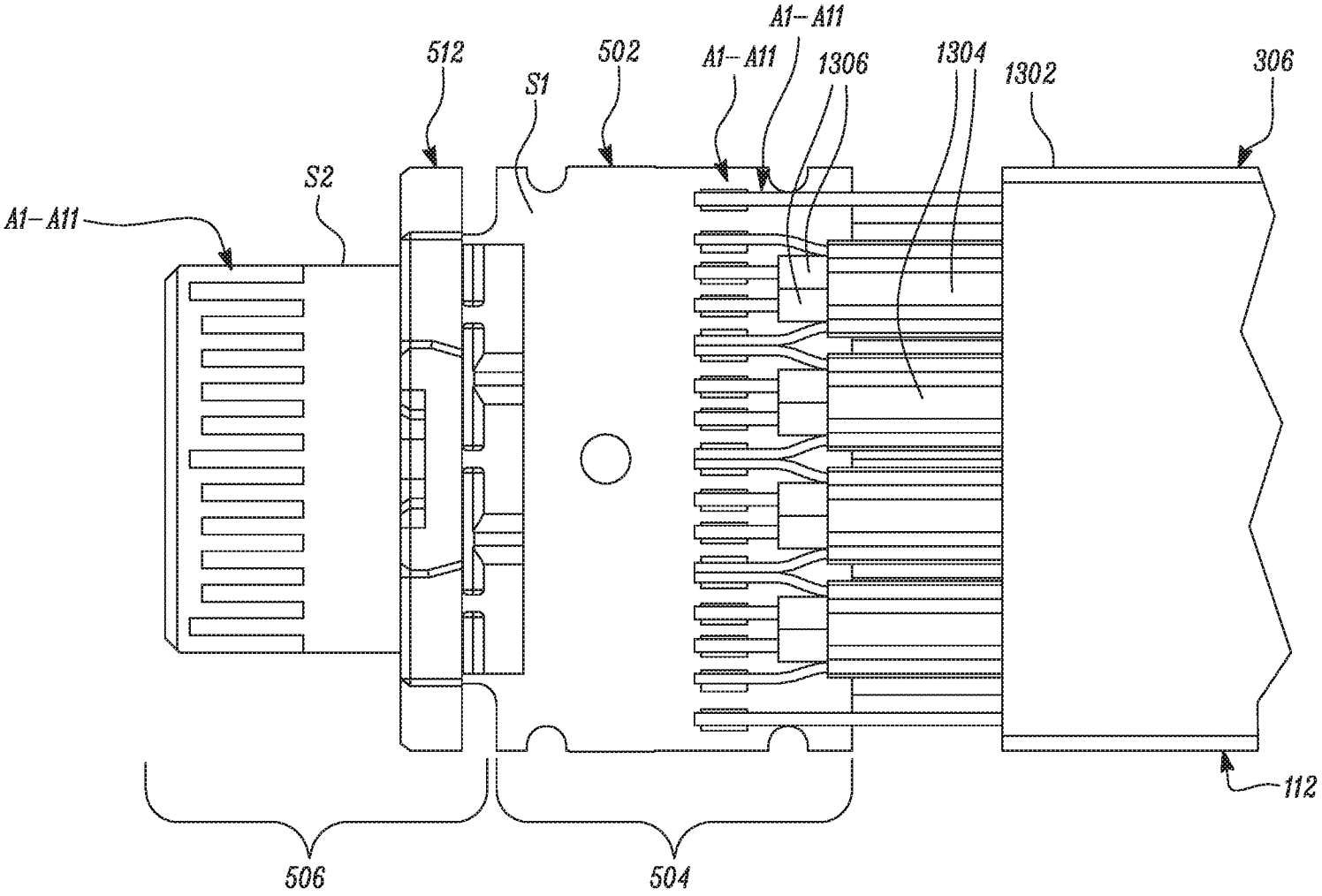

In embodiments, the plug-connector assembly 302 includes a stop member 508, as shown in FIGS. 5 and 15. The stop member 508 engages the second portion 506 of the secondary PCB 502. In embodiments, the plug-connector assembly 302 also includes a holder 512 (for example, as shown in FIGS. 3, 5, and 6). This holder 512 is preferentially made of a non-conducting material and may be a dielectric. For example, the holder 512 may be made from a dielectric thermoplastic polymer, such as polyvinylidene fluoride (PVDF), a dielectric thermoplastic elastomer (TPE), such as polyurethane (PUR), ethylene propylene rubber (EPR), or another suitable polymer or material. The holder 512 may be formed through an extrusion process. Alternatively, the holder 512 may be formed through a molding process, a lamination process, or another process. Holder 512 includes a socket 514 that can receive the first portion 504 of the secondary PCB 502 and mate with the stop member 508 via a tongue and groove joint 310. In embodiments, another mating type beside the tongue and groove joints is used.

Figure 20:
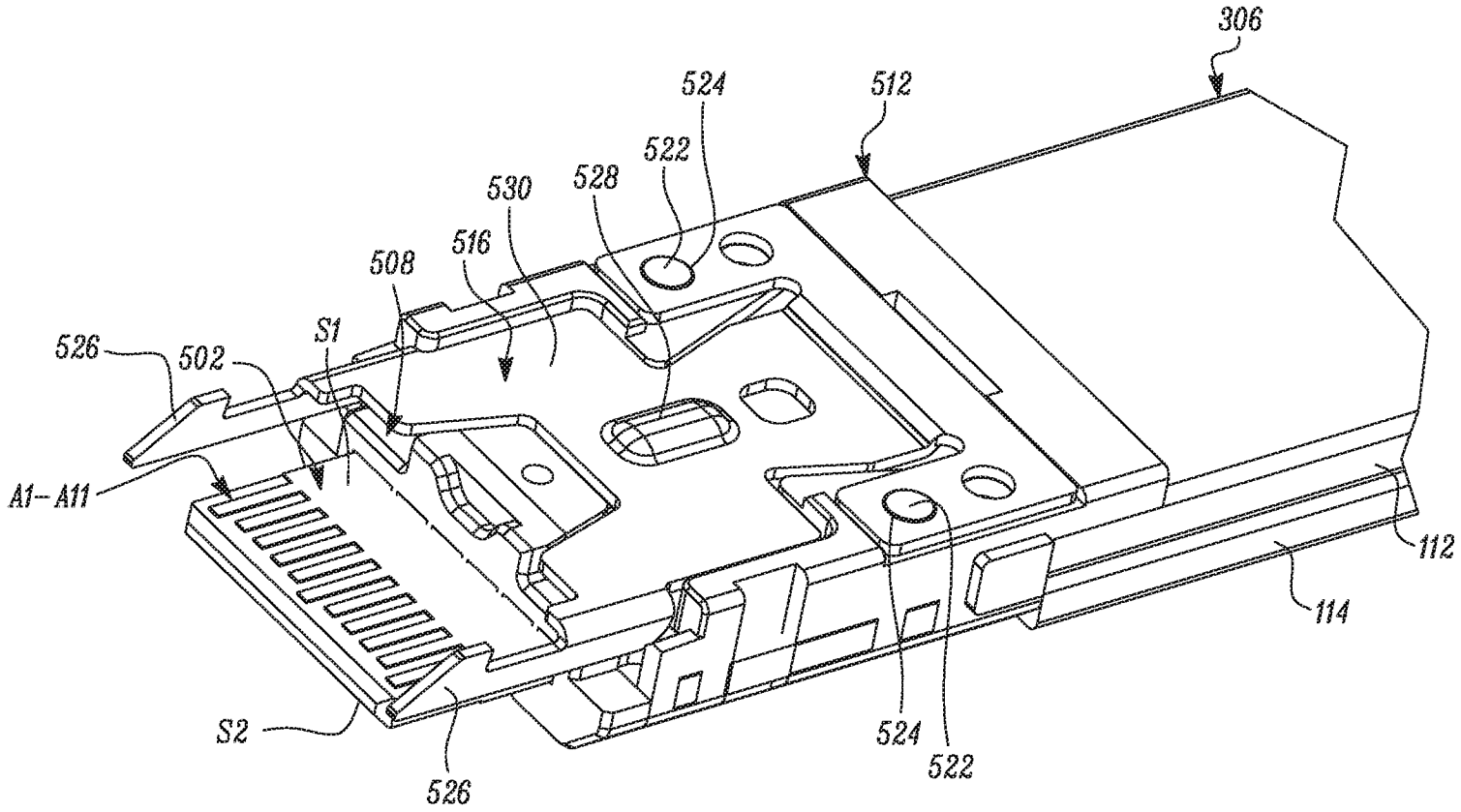

In embodiments, the plug-connector assembly 302 also includes a latch 516, as shown in FIGS. 3, 5, and 20. Latch 516 is disposed within a recess 518, defined on a top surface 520 of the holder 512. The latch 516 mates to the holder 512 via mating pins and receptacles 522, 524, located on the top surface 520 of the holder 512 and the latch 516 respectively. The latch 516 also has a pair of catch members 526 and a raised portion 528 on the top surface 530 of the latch 516.

Figure 21:
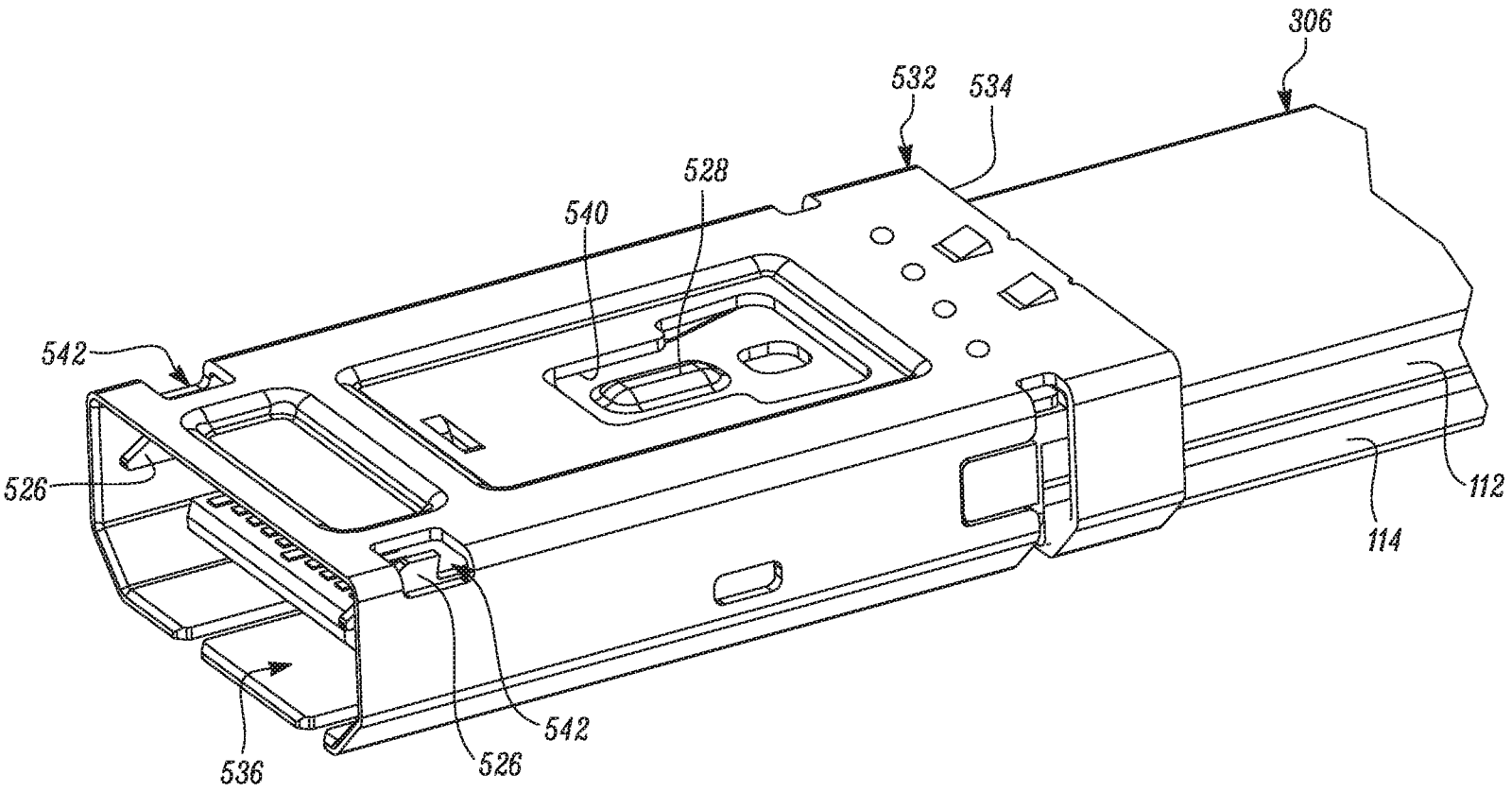
Figure 22:
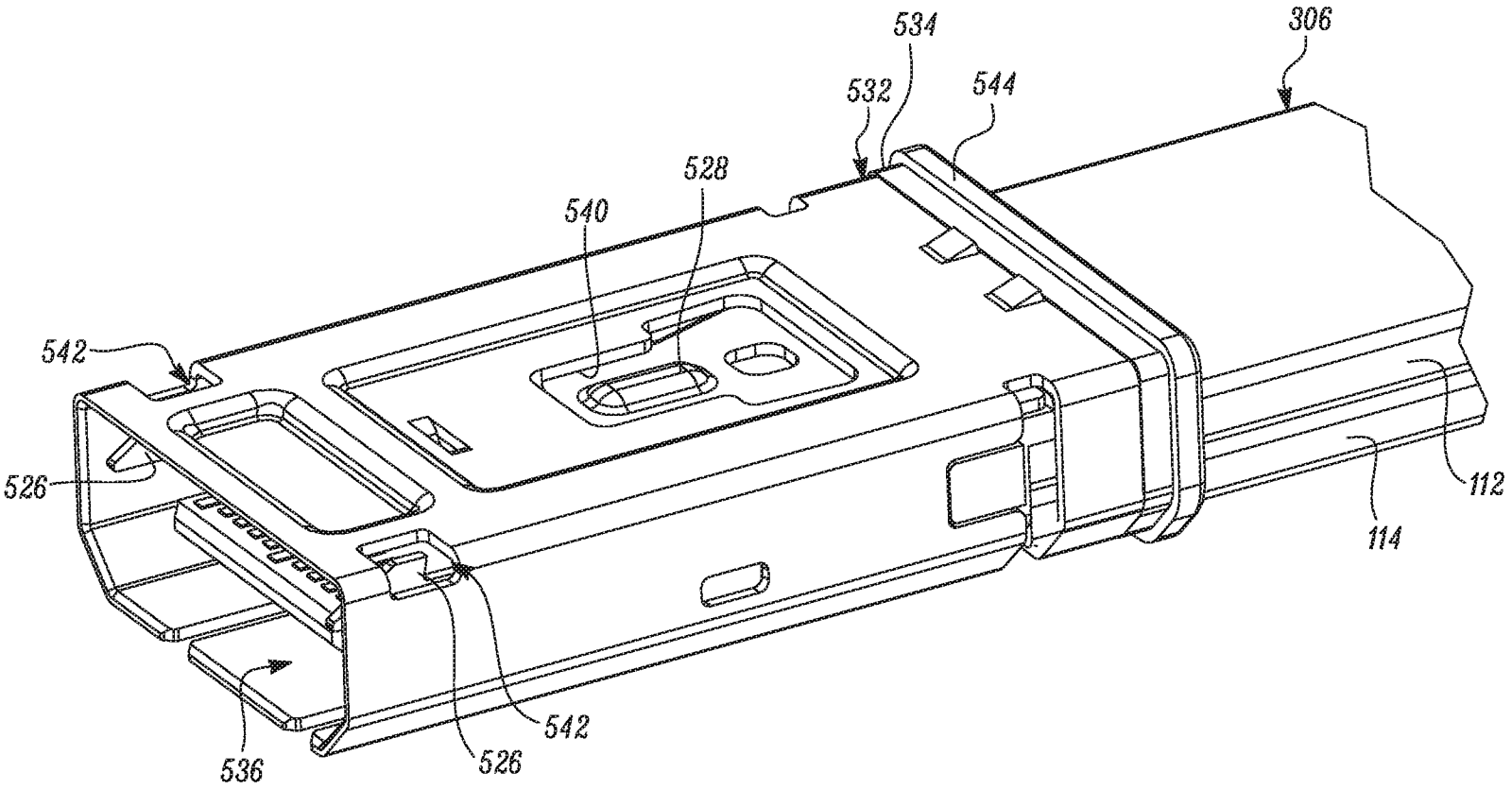
Figure 23:
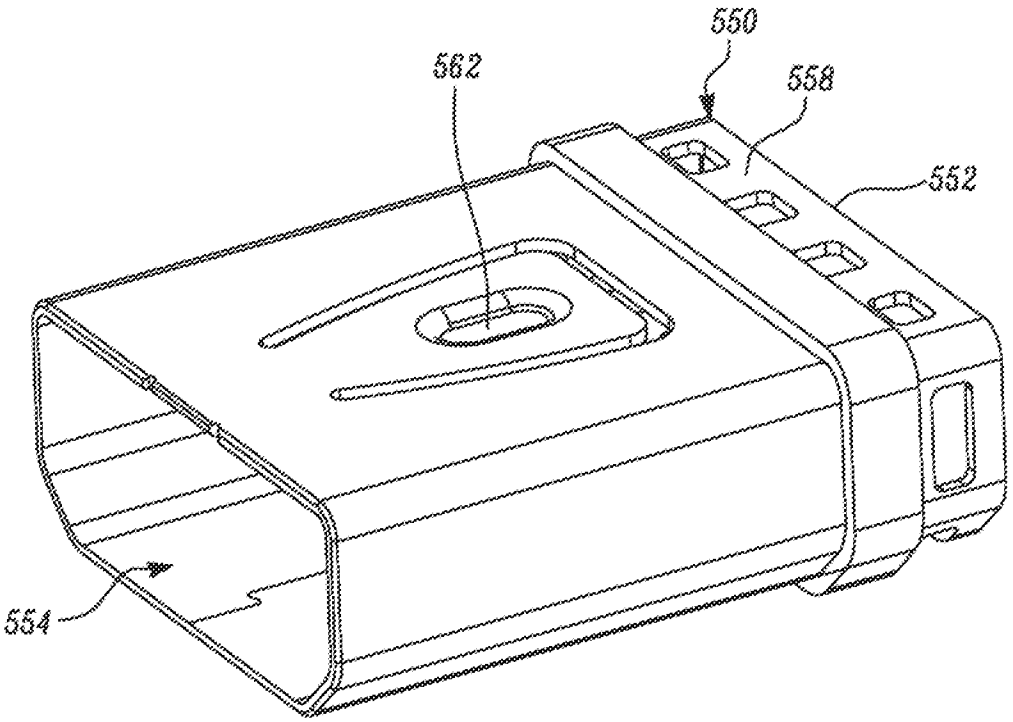
Figure 24:
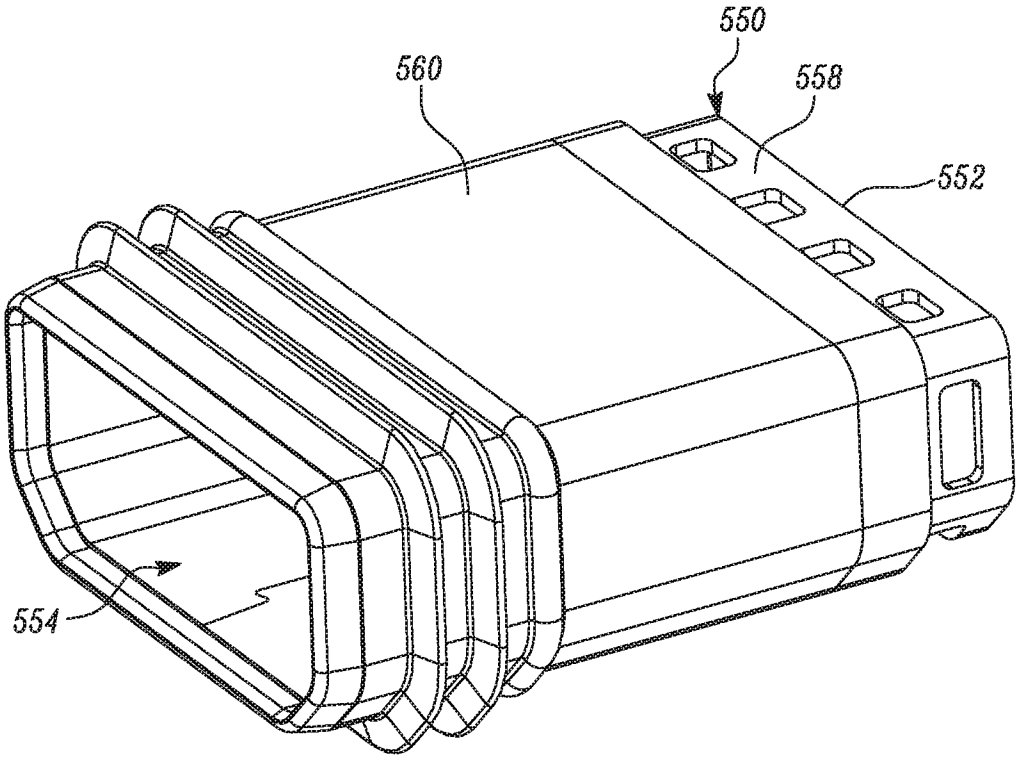

The plug-connector assembly 302 also has a first casing 532, as shown in FIGS. 3-6. The first casing 532 has a first open end 534 and a second open end 536. A top wall 538 of the first casing 532 defines a lateral opening 540. FIG. 21 shows the first casing 532 mated to the underlying latch 516 and holder 512, held by catch members 526. In embodiments, after the mating has been performed, the first casing 532 may be welded (for example, laser welded) to the underlying latch 516 or holder 512. In embodiments, the plug-connector assembly 302 also includes a support member 544 as shown in FIGS. 5 and 22. The support member 544 is disposed around the outer jackets 1302, 1402 of the cable assembly 306 by inserting the cable assembly 306 through an opening 546 of the support member 544. The cable assembly 306 may be inserted through the opening 546 of the support member 544 prior to attaching the conductors A1-A11 and B1-B11 of the cable assembly 306 onto the secondary PCB 502, i.e., prior to assembly process steps depicted in FIGS. 16 and 17, or at least prior to, assembling the first casing 532 for securing the latch 516, the holder 512, and the stop member 508 onto the cable assembly 306, i.e., prior to the assembly process step depicted in FIG. 21.

Figure 25:
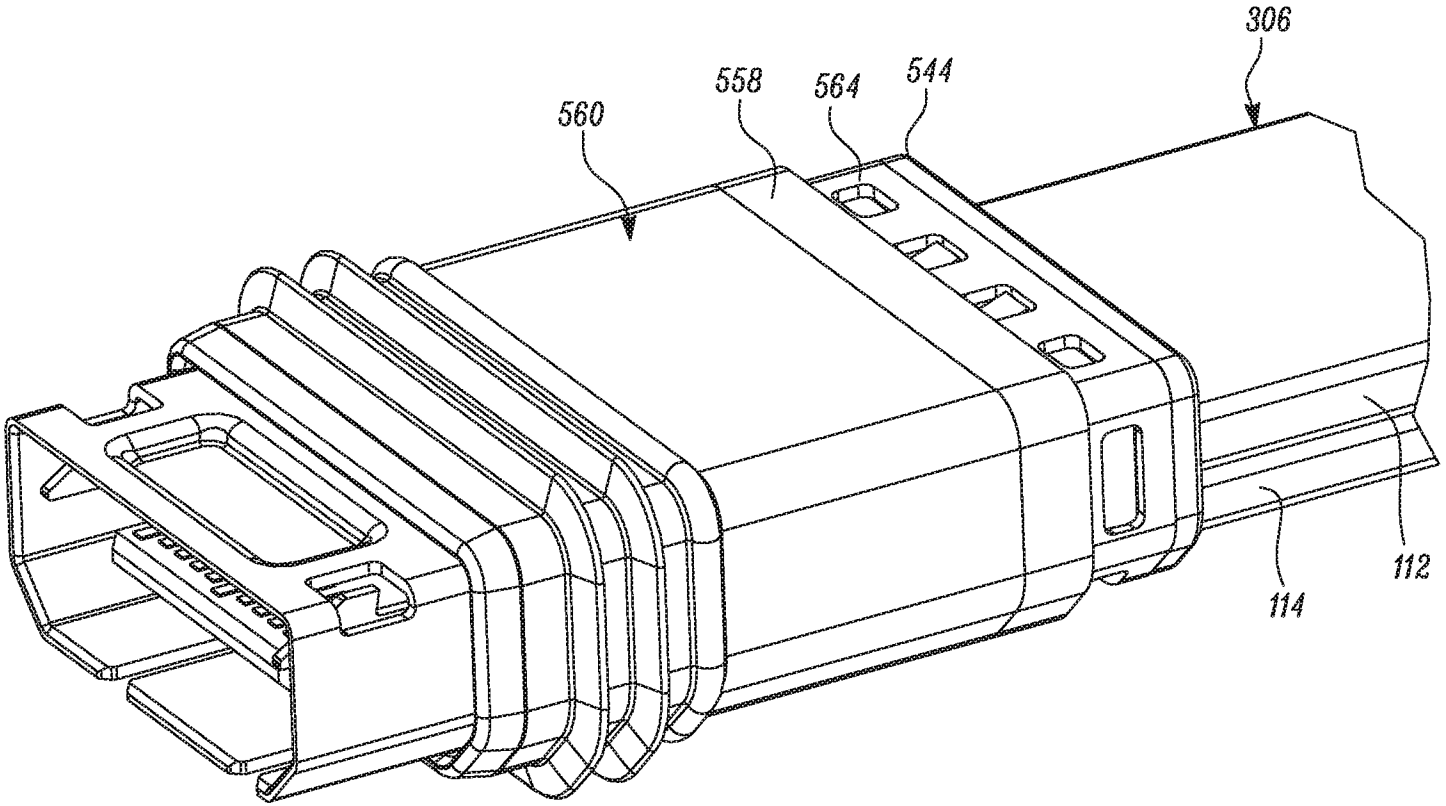

The plug-connector assembly 302 includes a second casing 550, as shown in FIGS. 3, 5 and 23-25. The second casing 550 has a first open end 552 and a second open end 554. In embodiments, the plug-connector assembly 302 includes a first dielectric portion 560 of outer surface 558. As shown in FIG. 25, the second casing 550 is disposed over the first casing 532. The second casing 550 may be slid over the first casing 532 via the first open end 552 of the second casing 550.

Upon assembling the second casing 550 with the first casing 532, a recessed flexible portion 562 of the second casing 550 latches with the raised portion 528 of the latch 516. When a sufficient amount of pressure is applied by a user to bias the latch 516 into the recess 518 of the holder 512, the pressure causes the latch 516 to traverse the width W of the recess 518 of the holder 512 (or a portion thereof) and release the catch members 526 from the corresponding openings 542.

Figure 26:
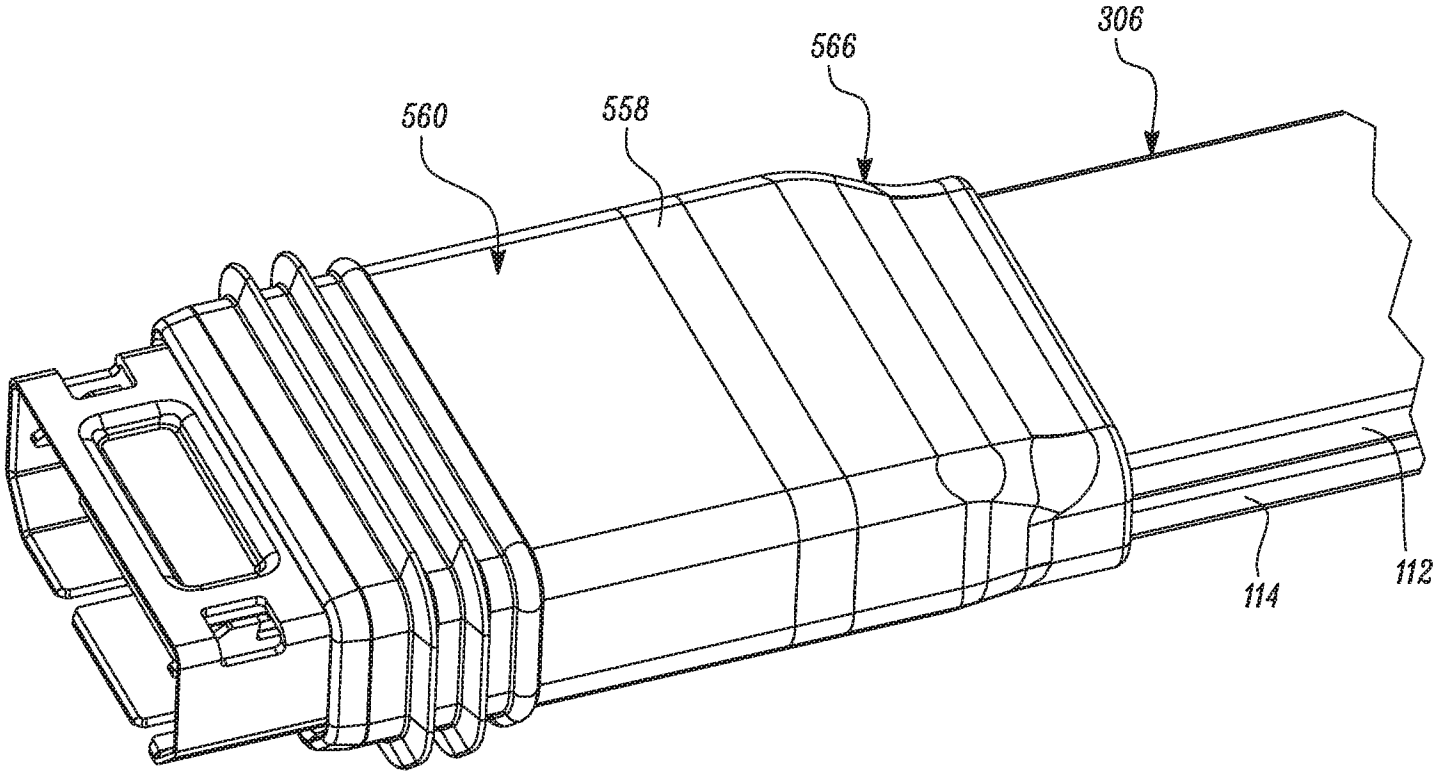
Figure 27:
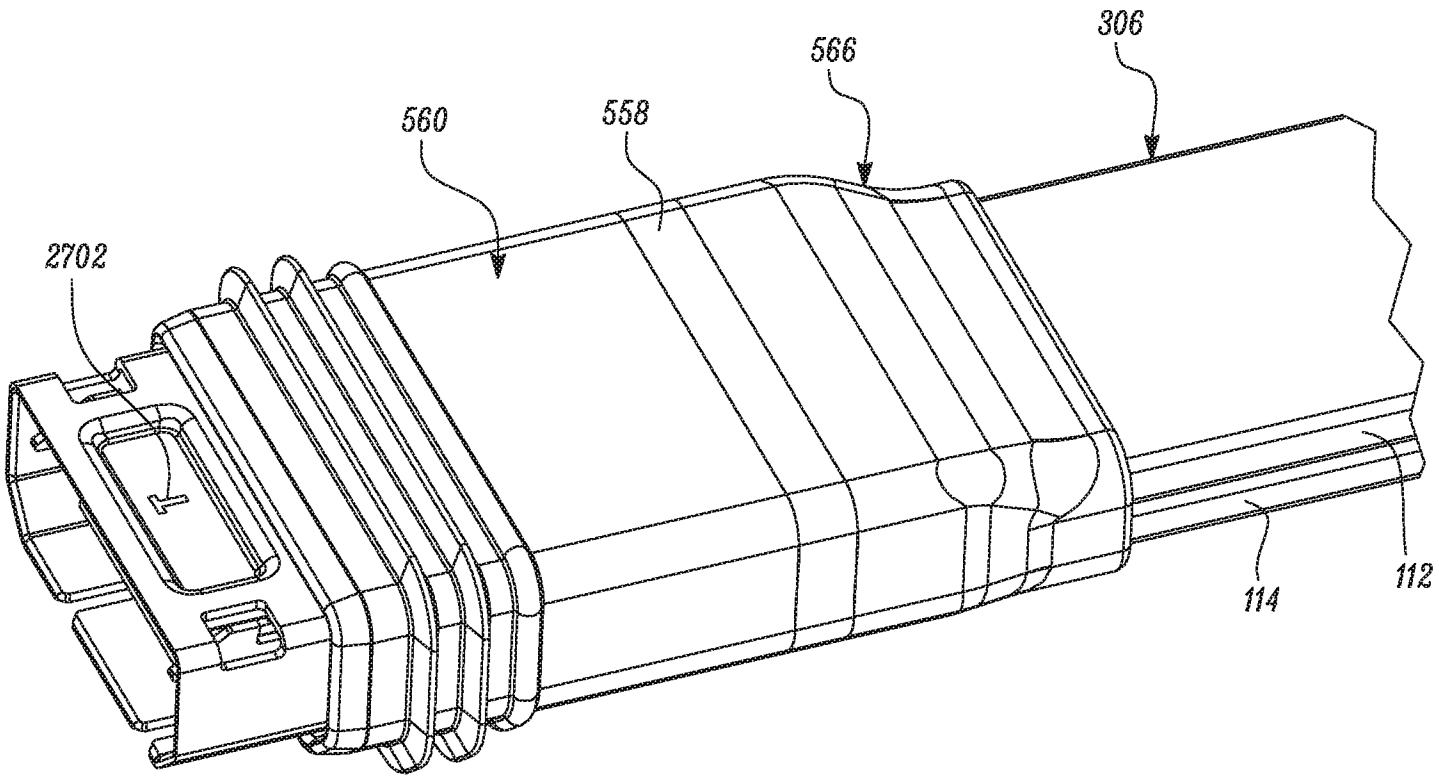

Further, referring to FIGS. 3, and 5, the plug-connector assembly 302 includes a second seal member 566, and as best shown in FIG. 26, this second seal member 566 is disposed between the support member 544 and the circumference of the outer jackets 1302, 1402 of the cable assembly 306. The second seal member 566 may be slipped onto the outer jackets 1302, 1402 of the cable assembly 306 either prior to stripping the cable assembly 306, i.e., prior to the assembly process steps depicted in conjunction with FIGS. 13 and 14, or prior to assembling the second casing 550 onto the first casing 532 i.e., prior to the assembly process step depicted in conjunction with FIG. 25, or at least prior to inserting the cable assembly 306 through the opening 546 of the support member 544. FIG. 27 illustrates the assembled plug-connector assembly on the end of a cable assembly. A portion on the top wall 538 of the first casing 532 that extends forward of the first seal member 560 may be additionally, or optionally, marked with indicia 2702 that can help technicians prevent an incorrect assembly of the plug-connector assembly 302 with the receptacle-connector assembly 304.

Figure 11:
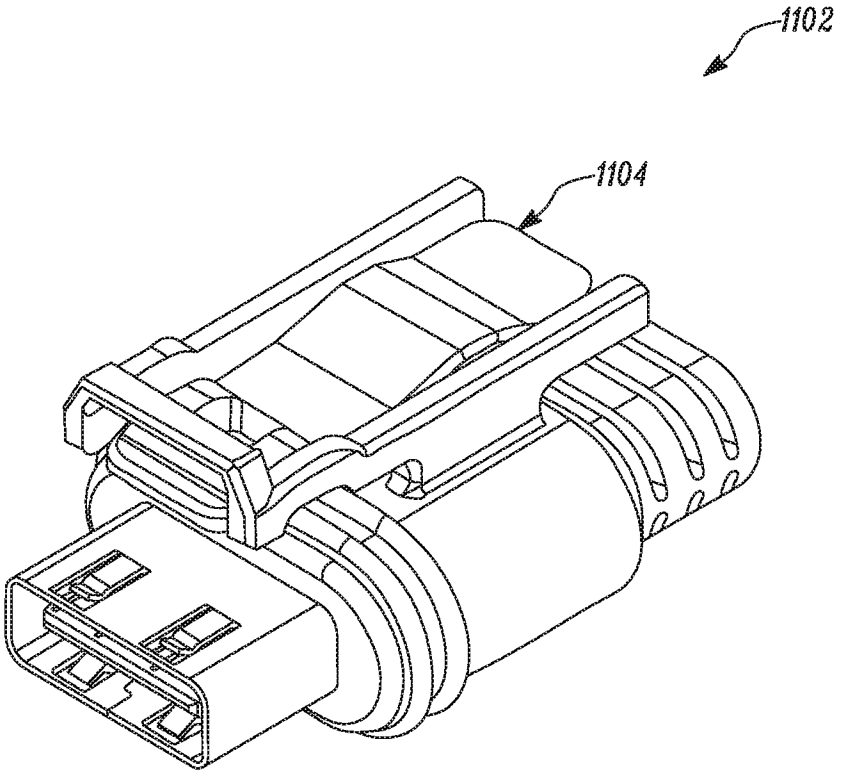
FIG. 11 illustrates a top perspective view of the plug-connector assembly having an external latch, according to certain embodiments of the current disclosure.
Figure 12:
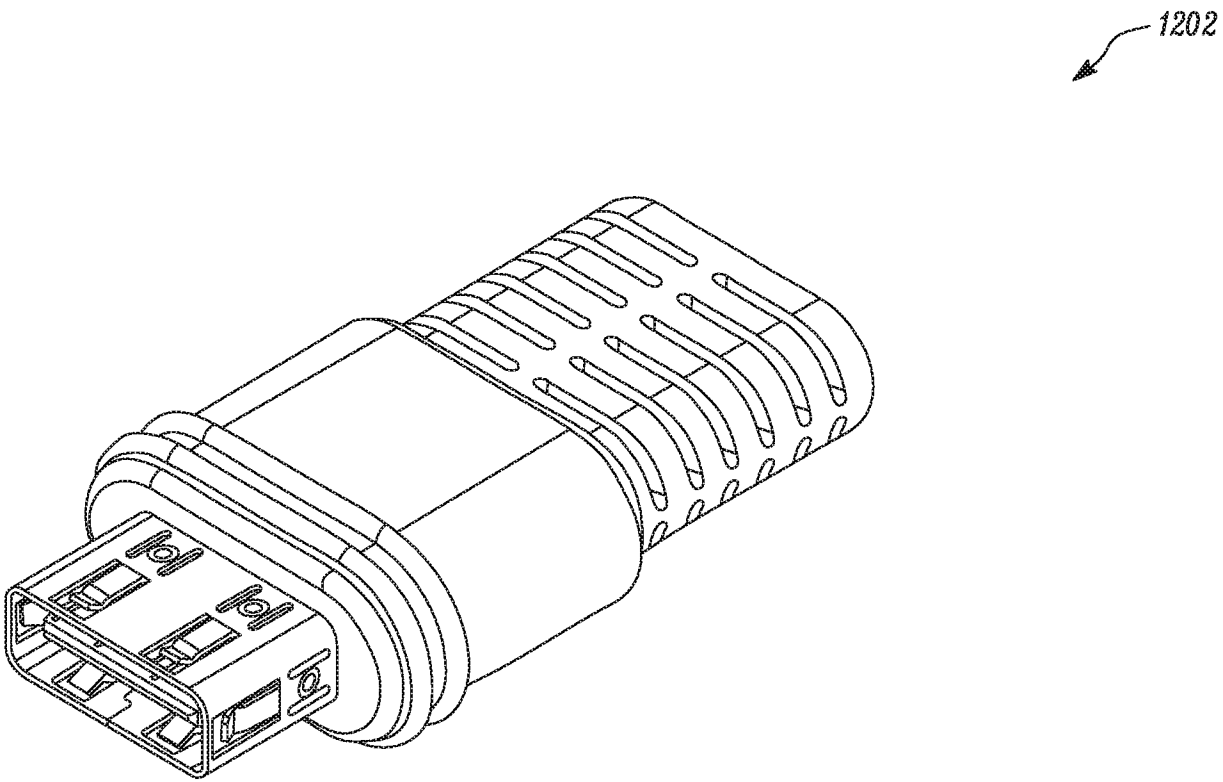
FIG. 12 illustrates a top perspective view of the plug-connector assembly without a latch, according to certain embodiments of the current disclosure.

In certain embodiments, although the latch 516 is shown located within the second casing 550 of the plug-connector assembly 302, a latch 1104 could be part of the outer casing of the plug-connector assembly and may be located externally as shown by way of example in the plug-connector assembly 1102 of FIG. 11. In other embodiments, a plug-connector assembly, for example, the plug-connector assembly 1202 shown in FIG. 12 may be devoid of any latching means to facilitate securement with the receptacle-connector assembly 304.

Receptacle-Connector Assembly

FIGS. 7-9 show an assembled perspective view, an exploded view, and a front view of a receptacle-connector assembly 304 according to certain embodiments of the present disclosure. As shown, the receptacle-connector assembly 304 includes a housing 702 having a first end 704 and a second end 706. In certain embodiments, the housing 702 is formed through a molding process. The receptacle-connector assembly 304 also includes an outer casing 738 that is engaged to the housing through catch member 740. As shown in FIG. 3, the outer casing 738 has a closed end 744 and an open end 746. This outer casing 738 is adapted i.e., sized and/or shaped to establish an interference fit with the plug-connector assembly 302. In embodiments, the thickness of the outer casing 738 is in the range of 0.1 millimeter to 10 centimeters. In embodiments, the outer casing 738 is made of plastic. In other embodiments, the outer casing 738 is made of metal. In embodiments, the outer casing 738 has one or more legs to engage with a PCB.

The first end 704 of the housing 702 has multiple first slots 710 on the top portion of the housing and multiple second slots 714 on the bottom portion of the housing. In embodiments, the receptacle-connector assembly 304 includes a separator portion 718 that is at least partially disposed in the gap 716 between the multiple first slots 710 and multiple second slots 714. In certain embodiments, the separator portion 718 is integrally formed with the housing 702.

As shown in FIGS. 3 and 8, the receptacle-connector assembly 304 has a first support 720 between the separator portion 718 and the top portion 708 of the housing. The receptacle-connector assembly 304 also includes a second support 722 between the separator portion 718 and the bottom portion 712 of the housing 702. In certain embodiments, the first support 720 and the second support 722 are made of a thermoplastic polymer.

With continued reference to FIGS. 3 and 8, the receptacle-connector assembly 304 further includes a first set of tiered conducting pins A1-A11 that extend through a first set of apertures 726 in the first support 720 and are disposed at least partly within the first slots 710. The receptacle-connector assembly 304 also includes a second set of L-shaped conducting pins B1-B11 that extend through a second set of apertures 730 in the second support 722 and are disposed at least partly within the second slots 714 defined in the bottom portion 712 of the housing 702.

Each pin from the first set of tiered conducting pins A1-A11 and the second set of L-shaped conducting pins B1-B11 has a second end 736 that may be connected to the PCB, for example by welding. In embodiments, each pin from the first set of tiered conducting pins A1-A11 and the second set of L-shaped conducting pins B1-B11 is separated from an adjacent conducting pin by a repeatable pitch. In embodiments, one or more conducting pins are connected to a ground conductor. In embodiments, each pin from the first set of tiered conducting pins A1-A11 and the second set of L-shaped conducting pins B1-B11 has an impedance of between 40 and 50 Ohms. In other embodiments, each of these pins may have an impedance in the range of 80 to 90 Ohms.

Figure 10:
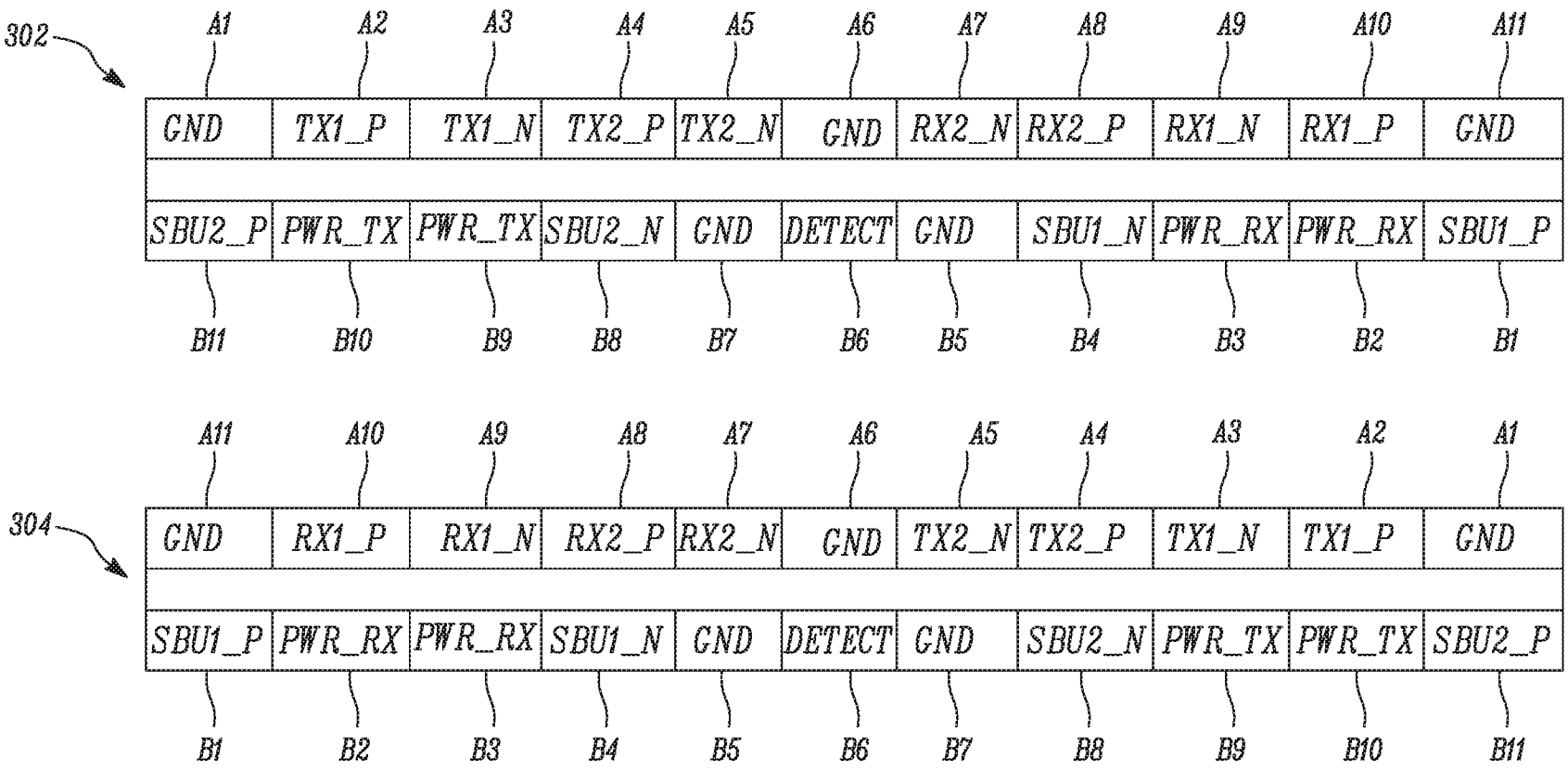
FIG. 10 illustrates a pin layout for the plug-connector assembly and the receptacle-connector assembly, according to certain embodiments of the current disclosure.

FIG. 10 illustrates a positioning of various conductors within the plug and receptacle connector assemblies 302, 304 of the connector assembly 300 according to a certain embodiment of the current disclosure. As shown, the plug and receptacle connector assemblies 302, 304 include multiple pins. The conducting portions associated with the plug-connector assembly 302 and the conducting portions associated with the receptacle-connector assembly 304 have been arranged linearly. For instance, a first row 112 and a second row 114, each having 11 pins (A1-A11 and B1-B11), is shown to be associated with the plug-connector assembly 302 while a first row 112 and a second row 114, each having 11 pins (A1-A11 and B1-B11), is shown to be associated with the receptacle-connector assembly 304.

In embodiments, plug-connector assembly 302, has 22 pins, each of which may correspond to at least one conductor from the cable assembly 306. In the illustrated embodiment of FIG. 10, pins A1, A6, A11, B5, and B7 of plug-connector assembly 302 are ground pins. These pins are connected to a ground conductor. Similarly, pins B2, B3, B9 and B10 of the plug-connector assembly 302 are power pins that connect to a power conductor. At times, certain pins may be omitted. When pins are omitted, they may later be assigned and ultimately connected to conductors. The arrangement of pins may change depending on the specific connector assembly and transmission requirements.

In certain embodiments, there are eleven conductors corresponding to pins A1 to A11 that connect to plug-connector assembly 302 and receptacle-connector assembly 304 with the pin configuration shown in FIG. 10. The eleven conductors consist of four pairs of conductors for high-speed data transfer. These pairs are high-speed pairs that preferentially aggregate to at least 30 Gbps (raw) bandwidth for a three-meter-cable length. Three conductors are ground conductors.

In certain embodiments, there are eleven conductors corresponding to pins B1 to B11 that connect to plug-connector assembly 302 and receptacle-connector assembly 304 with the pin configuration shown in FIG. 10. The eleven conductors consist of two pairs of secondary bus conductors, which connect to the SBU1 and SBU2 pins (B1, B4 and B8, B11). These secondary bus conductors may be unshielded and singled ended. Two pairs are power conductors capable of carrying up to 1.5 A current delivery and have DC resistances. Two ground conductors are connected to pins B5, and B7. Each of the conductors is preferably shielded and terminated into the connector assembly through a metal shell on each end.

With respect to pins B1-B11 in this configuration, pins B2, B3, B9 and B10 of connector assemblies 302, 304 are power pins that connect to a power conductor. Pins B2 and B3 of plug-connector assembly 302 correspond to PWR_TX pins which, when mated with corresponding receptacle pins, deliver power into the cable assembly from the power source where receptacle-connector assembly 304 is seated. SBU1 and SBU2 pins B1, B4 and B8, B11 connect to two pairs of secondary bus conductors. Pins B5 and B7 are ground conductor pins. DETECT pin at B6 is defined to detect an event when plug-connector assembly 302 is fully seated into receptacle-connector assembly 304, forming electrical contacts at all pins. DETECT pin is weakly pulled up high on the receptacle side until it mates with a plug-side pin. When a plugging event occurs, it is pulled down to ground. DETECT pin typically has the smallest size compared with the rest of pins to become the last pin to engage and the first pin to disengage.

In the pin configurations shown in FIG. 10, the pinout of receptacle-connector assembly 304 is the mirror image of the pinout of plug-connector assembly 302. TX1 high-speed pair of one connector assembly maps to TX1 pair of the other connector, and TX2 pair to TX2 pair. Likewise, RX1 high-speed pair of one connector assembly maps to RX1 pair of the other connector, and RX2 pair to RX2 pair. Moreover, PWR_TX of one connector assembly maps to PWR_TX of the other connector assembly and likewise, PWR_RX of one connector assembly maps to PWR_RX of the other connector assembly. SBU1 pair of one connector assembly maps to SBU1 pair of the other connector assembly and likewise, SBU2 pair of one connector assembly maps to SBU2 pair of the other connector assembly. Drain conductors and ground conductors tied together on the plug board serve as return paths for both power and common-mode components of high-speed and low-speed signals.

In certain embodiments, each of high-speed differential pairs meet or exceed the differential insertion loss, normalized based on 90-Ohm differential as shown in FIG. 28. In certain embodiments, each of high-speed differential pairs meet or exceed the differential return loss, normalized based on 90-Ohm differential as shown in FIG. 29. In certain embodiments, each of high-speed differential pairs meet or exceed the through mode-conversion loss (SCD21, differential to common mode conversion), normalized based on 90-Ohm differential as shown in FIG. 30. In certain embodiments, near-end crosstalk between any two pairs of opposite directions meet or exceed the differential crosstalk limit, normalized based on 90-Ohm differential as shown in FIG. 31. In certain embodiments, far-end crosstalk between two pairs of the same direction meet or exceed the differential crosstalk limit, normalized based on 90-Ohm differential as shown in FIG. 32.

AC performances of cable assemblies are known to be de-rated at harsh environmental conditions i.e., worse losses and impedance discontinuities when exposed to extreme humidity and/or extreme temperature compared to normal conditions. In embodiments, the connector assemblies 106, 108 or 302, 304 disclosed herein meet the insertion loss requirements at nominal state. In certain embodiments, all high-speed pairs meet or exceed the following insertion loss requirements with reference normalized to 90-Ohm, differential. As shown in FIG. 28, the insertion loss at nominal state is no greater than −0.5 dB@0.1 GHz, −1.25 dB@2.5 GHz, −2.0 dB@5 GHz, −3.0 dB@10 GHz, and −4.0 dB@15 GHz, respectively.

In certain embodiments, all high-speed pairs meet or exceed the return loss requirements shown in FIG. 29, with reference normalized to 90-Ohm, differential. As shown in the FIG. 29, the return loss at nominal state is no greater than −20 dB@0.1 GHz, −15 dB@2.5 GHz, −15 dB@5 GHz, −10 dB@7.5 GHz, −10 dB@10 GHz and −6 dB@15 GHz.

In certain embodiments, for frequencies between 2.5 GHz to 15 GHz, mode conversion is bounded to −20 dB at nominal state and −28 dB at a frequency of 0.1 GHz as shown in FIG. 30.

In certain embodiments, each of the high-speed pairs meet or exceed the near-end crosstalk requirements shown in FIG. 31, with reference normalized to 90-Ohm, differential. As shown in the FIG. 31, the near-end crosstalk at nominal state is no greater than −36 dB@0.1 GHz to 5 GHz, −30 dB@10 GHz, and −24 dB@15 GHz.

In certain embodiments, each of the high-speed pairs meet or exceed the far-end crosstalk requirements shown in FIG. 32, with reference normalized to 90-Ohm, differential. As shown in the FIG. 32, the far-end crosstalk at nominal state is no greater than −34 dB@0.1 GHz to 2.5 GHz, −30 dB@5 GHz, and −24 dB@10 GHz to 15 GHz.

In embodiments, when connector assemblies are properly mated, the connector assemblies and the cable meet IP65/IP6K9K dust and water proof compliance. In certain embodiments, the connector assemblies and the cable meet or exceed IPX4 rating in accordance with IEC standard 60529. That is, the connector assemblies and the cable can preferentially withstand accidental splash of water. In certain embodiments, the connector assemblies and the cable meet a higher rating, such as IPX7 which indicates withstanding accidental immersion in one meter of water for up to thirty minutes. A rim structure, one or more O-rings, a liquid gasket, cure-in-place, or form-in-place gasket or face seal, or another structure may be used to achieve the IPX4 or above rating. In other embodiments, the connector assemblies and the cable are IPX8 rated for continuous underwater use.

Further, in other embodiments, the cable with mated connectors, and conductor terminations preferentially tolerate profiles of thermal cycle and static thermal stress according to USCAR-21 Revision 3 specification. If transient electrical discontinuity occurs, the time duration does not exceed more than 1 μs.

Compliance limits of thermal shock resistance and vibration resistance is particularly important for automobile applications since large temperature may result from through ambient temperature fluctuations and through operation (for example, heat generated during electric vehicle battery discharge or motor operation).

In certain embodiments, the cable with mated conductors, and conductor terminations preferentially tolerate a vibration resistance according to USCAR-2 Revision 6 specification. The cable with mated conductors, and conductor terminations also tolerates mechanical shocks produced by potholes or something equivalent. The cable maintains the quality contacts during and at the end of the following two tests: 1) 400 cycles of 12 G peak half-sine accelerations for 20 ms in each of the 6 directions (i.e. positive and negative directions of x, y, and z axis's), and 2) 10 cycles of 35 G peak half-sine acceleration for 10 ms in the same 6 directions. If transient electrical discontinuity occurs during random vibrations and/or mechanical shocks, the time duration does not exceed more than 1 μs (micro-second).

In certain embodiments, the mating of each connector assembly 302/304 to the cable has a lock and key mechanism (for example, a notch in the plug-connector assembly 302 and a structure in the main cable structure that sits in the notch or vice versa) to allow only a single mating orientation between the plug-connector assembly 302 and the cable structure. In certain embodiments, a mechanical feature such as a key or notch is made on the overmold area so that mating is possible only in one (normal) orientation. The notch once properly mated with a counter structure on the receptacle side complies to IPX4 water proof requirement. In other embodiments, it should comply IP65/IP6K9K dust and water proof requirements.

The mating preferentially requires a force of 20N or less and 5N or more to be applied for the first 100 cycles and once mated, the mated plug-connector assembly 302 and main cable structure preferentially can withstand a pulling force of 200N or less and 75N or more for the first 100 cycles. However, more or less force may be required to mate the plug-connector assembly 302 with the main cable structure. The cable assembly 306 preferentially withstands a pulling force of at least 75N, such that no physical damage occurs when a pulling force of at least 75N is applied for one minute and while clamping one end of the cable assembly 306.

In certain embodiments, the DC resistance for power and ground paths meet the requirements specified in Table 1 for both stationary mode and vibrational/thermal (i.e., drive) mode to ensure that the IR drop across the cable assembly is 1400 mV or less for a 4 A power delivery. Preferentially, the DC resistance in the vibrational/thermal mode is <=5 Ohm for each of high-speed signals, and <=10 Ohm for the SBU signals.

TABLE 1

| Signal name | Conductor number | DCR, Max in stationary mode | DCR, Max under vibrational/thermal mode |
|---|---|---|---|
| HS1_P | 1 | 2.5 Ω | 5 Ω |
| HS1_N | 2 | 2.5 Ω | 5 Ω |
| HS2_P | 3 | 2.5 Ω | 5 Ω |
| HS2_N | 4 | 2.5 Ω | 5 Ω |
| HS3_N | 5 | 2.5 Ω | 5 Ω |
| HS3_P | 6 | 2.5 Ω | 5 Ω |
| HS4_N | 7 | 2.5 Ω | 5 Ω |
| HS4_P | 8 | 2.5 Ω | 5 Ω |
| LS1_P | 9 | 5.0 Ω | 10 Ω |
| LS1_N | 10 | 5.0 Ω | 10 Ω |
| LS2_N | 11 | 5.0 Ω | 10 Ω |
| LS2_P | 12 | 5.0 Ω | 10 Ω |
| PWR_TX | 13, 14 | 200 mΩ | 250 mΩ |
| PWR_RX | 15, 16 | 200 mΩ | 250 mΩ |
| GND | 17, 18, 19, 20 | 75 mΩ | 100 mΩ |
| Return path for a high-speed pair | | 750 mΩ | 1 Ω |

The foregoing disclosure is not intended to limit the present disclosure to the precise forms or particular fields of use disclosed. As such, it is contemplated that various alternative embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. For example, reference is made to "wire" or "wires," but a person of ordinary skill in the art will understand that in certain embodiments, one or more conductors (for example, metal without any insulation or outer sheathing) may be substituted. By way of another example, reference is made to "conductor" or "conductors," but a person of ordinary skill in the art will understand that in certain embodiments, one or more wires (such as, a metal conductor with insulation or an outer sheathing) may be substituted. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosed cable assembly. It is to be understood that the forms of disclosure herein shown and described are to be taken as representative embodiments. Equivalent elements, or materials may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application.

What is claimed is:

1. A cable assembly comprising:

a first cable and a second cable arranged parallel to the first cable, wherein proximal ends of the first and second cables are provided with a connector assembly each, the connector assembly from the proximal end of each of the first and second cables adapted to connect with a pair of receptacle ports located within a PCB disposed alongside the first and second cables, wherein at least one of the connector assembly comprises:

a secondary PCB having:

a first side defining a plurality of first conducting portions attached to corresponding ones of first conductors from a plurality of first conductors present on one of the first and second cables; and a second side defining a plurality of second conducting portions attached to corresponding ones of second conductors from a plurality of second conductors present on one of the first and second cables, wherein the secondary PCB has a stepped configuration to define a first portion in a first direction and a second portion in a second direction, the first portion having a first width and the second portion having a second width less than the first width; and a stop member engaged to the second portion of the secondary PCB such that a first side of the stop member is disposed in a spaced-apart relation to the first portion of the secondary PCB;

a holder defining a socket that laterally receives the first portion of the secondary PCB and establishes a mating relationship via a tongue and groove joint with the stop member between the first and second portions of the secondary PCB; and a latch disposed within a recess defined on a top surface of the holder and engaged to the holder via mating pins and receptacles defined on the top surface of the holder and the latch respectively, the latch having a pair of catch members extending laterally in the second direction.

2. The cable assembly of claim 1, wherein the connector assembly is formed from assembly of a receptacle-connector assembly with a plug-connector assembly.

3. The cable assembly of claim 1, wherein the connector assembly is formed when a pair of receptacle connector assemblies from proximal ends of the first and second cables are connected with the pair of receptacle ports on the PCB.

4. The cable assembly of claim 1, wherein the plurality of first conducting portions and the plurality of second conducting portions reside on the first portion of the secondary PCB.

5. The cable assembly of claim 1, wherein the plug-connector assembly includes a first seal member disposed in abutment with an outer surface of the second casing.

6. The cable assembly of claim 1, wherein the plug-connector assembly includes a second seal member disposed between the support member and the circumference of the outer jacket of one of the first and second cables.

7. The cable assembly of claim 1, wherein the latch defines a raised portion thereon that corresponds with a recessed flexible portion defined on a top wall of the second casing.

8. The cable assembly of claim 7, wherein the raised portion of the latch and the recessed flexible portion of the second casing abut with one another via a lateral opening defined in a top wall of the first casing.

9. The cable assembly of claim 1, further comprising a first casing having first and second open ends in the first and second directions respectively, the first casing received onto the latch, the holder, and the stop member via the first open end of the first casing such that the first open end is disposed in a spaced-apart relation alongside an outer jacket of one of the first and second cables and the pair of catch members from the latch are engaged with corresponding openings defined on the first casing.

10. The cable assembly of claim 9, further comprising a second casing having first and second open ends in the first and second directions respectively, the second casing received onto the first casing via the first open end of the second casing and spot welded to the first casing.

11. The cable assembly of claim 1, further comprising a support member disposed around a circumference of the outer jacket of one of the first and second cables and engaged with the first open end of the first casing.

12. A cable assembly comprising:

a first cable and a second cable arranged parallel to the first cable, wherein proximal ends of the first and second cables are provided with a connector assembly each, the connector assembly from the proximal end of each of the first and second cables adapted to connect with a pair of receptacle ports located within a PCB disposed alongside the first and second cables, wherein at least one of the connector assembly comprises:

a housing having a first end and a second end disposed in a first direction and a second direction respectively, a top portion of the housing adjacent the first end of the housing defining a plurality of first slots and a bottom portion of the housing adjacent the first end of the housing defining a plurality of second slots, the plurality of first and second slots arranged in a horizontally stacked configuration and disposed in a spaced-apart relation to one another for defining a gap there between;

a separator portion at least partially disposed in the gap and extending from between the first and second ends of the housing to terminate at a pre-determined distance outside the housing in the second direction;

a first support positioned between the separator portion and the top portion of the housing adjacent the second end of the housing;

a second support positioned between the separator portion and the bottom portion of the housing adjacent the second end of the housing;

a first set of tiered conducting pins extending through a first set of apertures in the first support and disposed at least partly within the plurality of first slots defined in the top portion of the housing; and a second set of L-shaped conducting pins extending through a second set of apertures in the second support and disposed at least partly within the plurality of second slots defined in the bottom portion of the housing.

13. The cable assembly of claim 12, wherein the first set of tiered conducting pins have downwardly arched first ends disposed proximal to the first end of the housing and the second set of L-shaped conducting pins have upwardly arched first ends proximal to the first end of the housing, the downwardly and upwardly arched first ends from the first set of tiered conducting pins and second set of L-shaped conducting pins disposed alongside one another.

14. The cable assembly of claim 13, wherein each conducting pin from the first set of tiered conducting pins and the second set of L-shaped conducting pins has a second end connected to the PCB by welding.

15. The cable assembly of claim 13, wherein each conducting pin from the first set of tiered conducting pins and the second set of L-shaped conducting pins has an impedance of between 40 and 50 Ohms.

16. The cable assembly of claim 13, wherein each conducting pin from the first set of tiered conducting pins and the second set of L-shaped conducting pins has an impedance of between 80 and 90 Ohms.

17. The cable assembly of claim 13, wherein each conducting pin from the first set of tiered conducting pins and the second set of L-shaped conducting pins is separated from an adjacent conducting pin by a repeatable pitch.

18. The cable assembly of claim 13, wherein one or more conducting pins are connected to a ground conductor and one or more pins are connected to a conductor capable of carrying high-speed data communications.

19. The cable assembly of claim 13, wherein the conducting pins include pins connected to conductors for data transmission, pins connected to conductors for power transmission, and pins connected to conductors for use as a secondary bus.

* * * * *